US006284449B1

(12) United States Patent
Nakayama et al.

(10) Patent No.: US 6,284,449 B1
(45) Date of Patent: Sep. 4, 2001

(54) SILVER HALIDE EMULSION AND SILVER HALIDE LIGHT SENSITIVE PHOTOGRAPHIC MATERIAL

(75) Inventors: Tomoyuki Nakayama; Tadahiro Nagasawa; Rieko Ren, all of Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/461,855

(22) Filed: Dec. 15, 1999

(30) Foreign Application Priority Data

Dec. 21, 1998 (JP) ..... 10-362801
Aug. 20, 1999 (JP) ..... 11-233953

(51) Int. Cl.[7] ..... G03C 1/005; G03C 1/494
(52) U.S. Cl. ..... 430/567; 430/569; 430/502
(58) Field of Search ..... 430/567, 569, 430/502

(56) References Cited

U.S. PATENT DOCUMENTS 5,266,450 11/1993 Takehara .
5,389,508 * 2/1995 Takada et al. ..... 430/569
5,627,018 * 5/1997 Nakayama ..... 430/567
6,080,535 * 6/2000 Kondo ..... 430/567

FOREIGN PATENT DOCUMENTS 0662632 1/1997 (EP) .

* cited by examiner

*Primary Examiner*—Geraldine Letscher
(74) *Attorney, Agent, or Firm*—Jordan B. Bierman; Bierman, Muserlian and Lucas

(57) ABSTRACT

A silver halide emulsion comprising silver halide grains is disclosed, in which at least 50% of total grain projected area is accounted for by silver halide regular crystal grains exhibiting a proportion of a (100) face per grain of not less than 50% and having an average iodide content of not more than 5 mol %; the silver halide grains having an internal high iodide phase having an average iodide content of not less than 7 mol % and accounting for 0.1 to 15% of the grain volume; the high iodide phase being in the region at a depth of from 7 to 27% from the (100) face, based on the distance between the center of a grain and the (100) face.

13 Claims, 9 Drawing Sheets

FIG. 4A
FIG. 4B
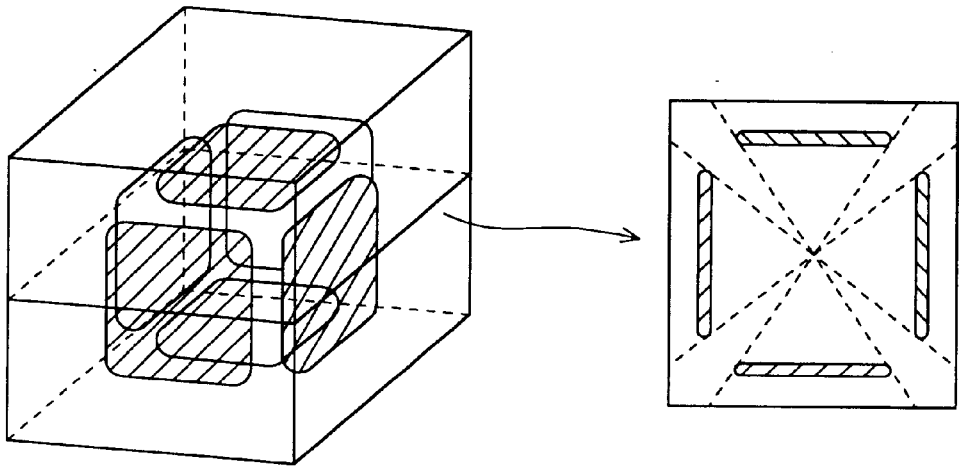
FIG. 5A
FIG. 5B
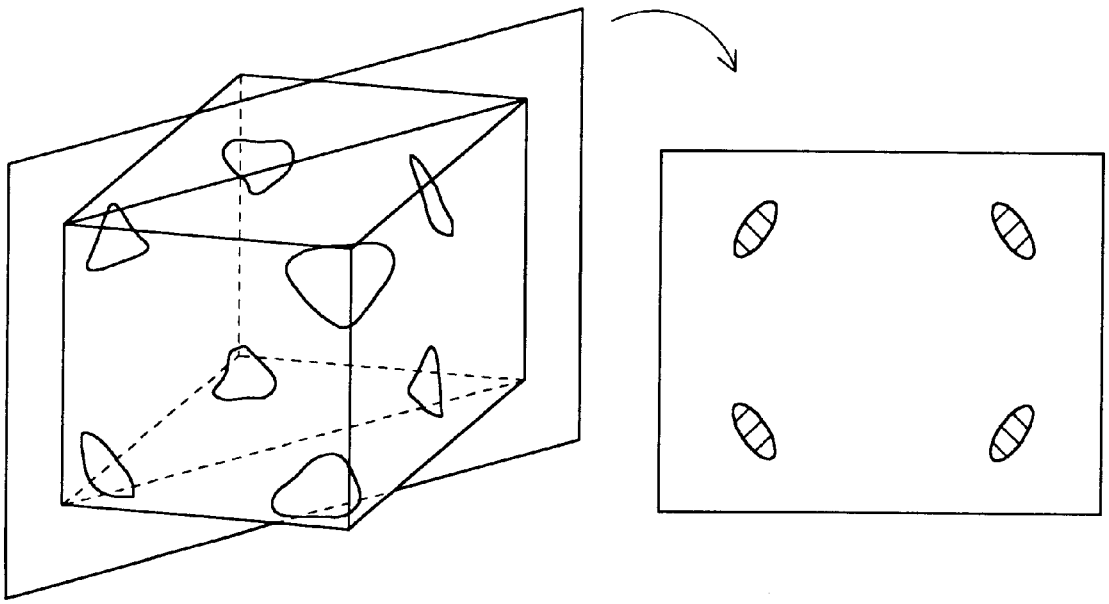

FIG. 6A
FIG. 6B
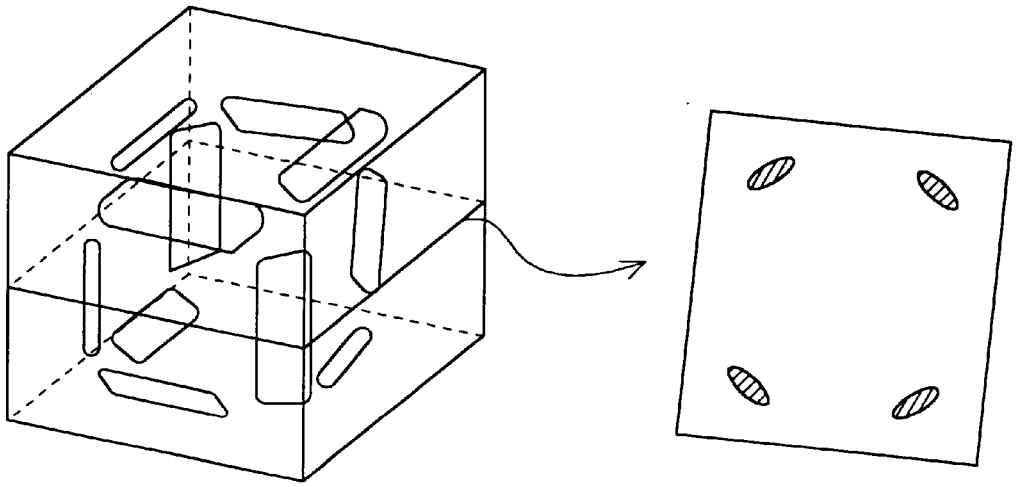
FIG. 7A
FIG. 7B
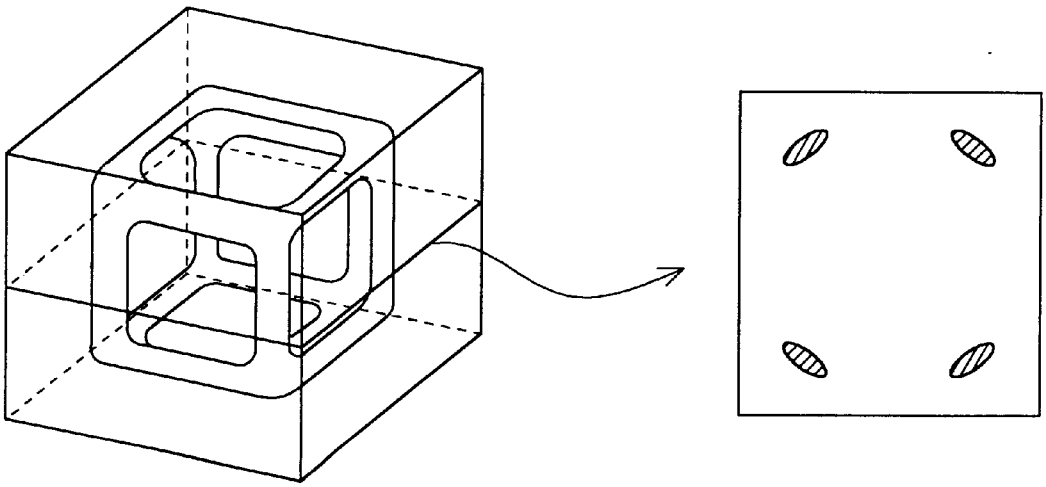

: UPWARD-ORIENTED (100) FACE REGION

SILVER HALIDE EMULSION AND SILVER HALIDE LIGHT SENSITIVE PHOTOGRAPHIC MATERIAL

FIELD OF THE INVENTION

The present invention relates to silver halide emulsions and silver halide light sensitive photographic materials containing the emulsions, and in particular to silver halide emulsions and silver halide light sensitive photographic materials which are improved in sensitivity, contrast, process stability and pressure resistance.

BACKGROUND OF THE INVENTION

Recently, the demand for improvements in photographic silver halide emulsions has become pronounced, and further, requirements have also been demanded for higher level photographic performance including higher speed, higher contras, superior process stability and pressure resistance.

The use of tabular silver halide grains as means for enhancing the sensitivity of silver halide emulsion and in particular for enhancing the quantum sensitivity thereof are described in U.S. Pat. Nos. 4,434,226, 4,439,520, 4,414,310, 4,433,048, 4,414,306 and 4,459,353; JP-A 58-111935, 58-111936, 58-111937, 58-113927 and 59-99433 (herein, the term, JP-A means a unexamined, published Japanese Patent Application). Techniques of introducing dislocation lines are generally known as a means for enhancing sensitivity and graininess. U.S. Pat. No. 4,956,269, for example, discloses the introduction of dislocation lines into tabular silver halide grains.

The tabular grain technique described above is effective to achieve enhanced sensitivity of silver halide emulsions. However, when the dislocation lines are applied to silver halide grains having a high aspect ratio (i.e., a ratio of grain diameter to grain thickness) to make the most of desired characteristics of the tabular grains, it was found that deterioration was caused in other photographic performance such as contrast, process stability or pressure resistance.

It is commonly known that application of pressure to silver halide grains causes fogging or desensitization. However, there was a problem that dislocation lines-introduced grains exhibited marked desensitization when subjected to pressure.

JP-A 59-99433, 60-35726 and 60-147727 disclose techniques for improving pressure characteristics using core/shell type grains. JP-A 63-220238 and 1-201649 disclose techniques for improving graininess, pressure characteristics and exposure temperature dependence as well as sensitivity by introducing dislocation lines into silver halide grains. Further, JP-A 6-235988 discloses a technique for enhancing pressure resistance by use of multilayer-structured, monodisperse tabular grains having a high iodide-containing intermediate shell.

Photogr. Sci. Eng. 18, 215–225 (1974) disclosed that cubic silver halide grains exhibited little desensitization in inherent sensitivity and high contrast when a sensitizing dye was allowed to be adsorbed thereon. However, specifically in the case of cubic grains, cubic grains containing 5% or less chloride, it was difficult to prepare completely cubic grains. Herein completely cubic grains refers to cubic-formed grains having overall external faces substantially formed of (100) faces. Accordingly, incompletely cubic grains refers to grains having external faces other than (100). In most cases, the face index other than (100) is (111) or (110) faces. In fact, such silver halide grains having external faces of plural face indexes are different in the face proportion from each other.

As a result of studies by the inventors of the present invention, it was found that a reduced variation coefficient of the proportion of (100) face among grains led to improvements in sensitivity, contrast and process stability, specifically when being subjected to reversal development. An adverse effect, due to a broad distribution of the face proportion is a difference in quantum sensitivity for each grain and it is contemplated to result in reduced contrast or reduced quantum sensitivity of overall silver halide grains. However, influences thereof have not definitely known.

It was further found that the broad distribution of the face proportion is not advantageous in terms of process stability and such non-advantageous effects were marked in development processing employing solution physical development. Examples thereof include a development process of color reversal photographic materials. It is assumed that variation in dissolution of silver halide grains is a phenomenon due to differences in stability in the developer between surfaces of different face indexes of the grain and non-uniformity among grains with respect to coverage of an adsorbing substance such as a sensitizing dye.

JP-A 5-341417 discloses that a high proportion of (100) faces is effective in enhancing performance, but there is nothing described with respect to effects of the distribution of the face proportion per grain among grains.

It was further found by the present inventors that a silver halide grain emulsion containing 5 mol % or less chloride and 0.5 mol % or more iodide, in which at least 50% of the total grain projected area was accounted for by regular crystal grains of at least 50% of the (100) face proportion for each grain and a coefficient of variation of the (100) face proportion among grains exhibited enhanced sensitivity, higher contrast and superior process stability.

JP-A 5-107670, 4-317050, 5-53232, 4-372943 and 4-362628 disclose techniques for introducing dislocation lines into regular crystal grains. However, it was proved that these techniques did not reach levels of recent requirements for higher sensitivity, higher contrast and improved process stability and pressure resistance.

In addition, it was found that forming an internal band-formed layer containing high iodide within the grain (hereinafter, also called high iodide contour) led to enhanced sensitivity and localization of the high iodide layer, resulting in improved pressure resistance. It was also proved that uniformity in crystal habit of the grain external faces was an important factor for enhancing uniformity among grains and achieving enhanced sensitivity, contrast and process stability. In the case of regular crystal grains, and specifically, in the case of cubic grains containing 5 mol % or less chloride, however, it is difficult to make the crystal habit of the grain external face uniform among the grains. Besides the (100) face, in most cases, a (111) or (110) face is present. In fact, such silver halide grains having external faces of plural face indexes were different in the face proportion from each other.

It was further found by the present inventors that a silver halide emulsion containing silver halide regular crystal grains having dislocation lines, in which a variation coefficient of the number of the dislocation lines among grains was 30% or less and when an outermost layer of the grain was present, led to superior performance in sensitivity, contrast and process stability, specifically when subjected to reversal development. It was further found that silver halide grains which included a small internal high iodide portion by volume within the grain, exhibited superior pressure resistance as well as enhanced sensitivity. JP-B 6-14173 (herein, the term, JP-B means a published Japanese Patent) discloses octahedral silver halide grains containing internally a high iodide layer. However, these grains are entirely different from those of the present invention with respect to the position of the high iodide layer and the crystal habit of the grains, and the effect thereof concerns an improvement in pressure fogging so that any effect of the present invention cannot be expected therefrom. It was also found that in silver halide grains, when the dislocation lines were orientated in the direction toward the corners or edges of the cubic grains or toward the grain surface of the (111) or (110) face, sensitization effects were further enhanced. The effects of the present invention were marked in color reversal photographic materials which were subjected to color reversal processing.

SUMMARY OF THE INVENTION

It is an object of the present invention to provide a silver halide emulsion exhibiting high sensitivity and high contrast and improved process stability and a photographic material by use thereof.

The object of the present invention can be accomplished by the following constitution:

(1) A silver halide emulsion comprising silver halide grains, wherein at least 50% of total grain projected area is accounted for by silver halide regular crystal grains exhibiting a proportion of a (100) face per grain of not less than 50% and having an average iodide content of not more than 5 mol %; the silver halide grains having an internal high iodide phase having an average iodide content of not less than 7 mol % and accounting for 0.1 to 15% of the grain volume; the high iodide phase being in the region at a depth of from 7 to 27% from the (100) face, based on the length of a perpendicular drawn from the center of a grain to the (100) face; and (2) a method of preparing a silver halide emulsion comprising silver halide regular crystal grains exhibiting a proportion of a (100) face per grain of not less than 50% accounting for at least 50% of total grain projected area and having an average iodide content of not more than 5 mol %, the silver halide grains having an internal high iodide phase having an average iodide content of not less than 7 mol % and accounting for 0.1 to 15% of the grain volume, the method comprising the steps of:

(i) forming nuclear grains by adding a silver salt and a halide salt to a mother liquor, (ii) ripening the nuclear grains, and (iii) growing the nuclear grains to form final grains by adding a silver salt and a halide salt, wherein in step (iii), fine silver iodide grains, an aqueous soluble iodide salt or an iodide ion releasing compound is added at a time after adding of 40% of the silver salt to be added and before adding of 80% of the silver salt to be added.

BRIEF EXPLANATION OF DRAWINGS

FIGS. 4A through 8B illustrate high iodide phases.

DETAILED DESCRIPTION OF THE INVENTION

Figure 1:
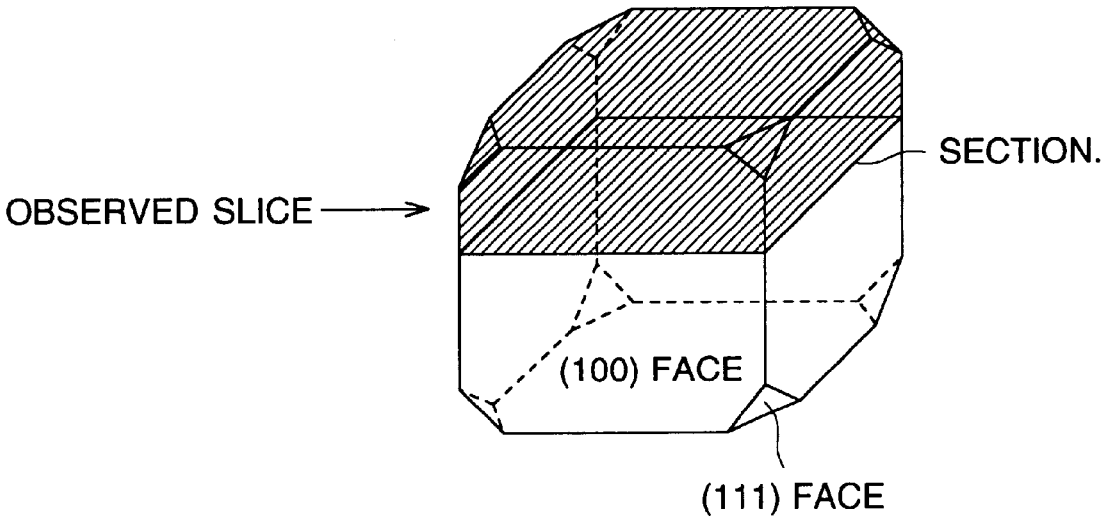
FIG. 1 illustrates a cubic-formed silver halide grain, which is sliced in parallel to a (100) face.

The silver halide regular crystal grains used in the invention refer to those which have a rock salt type structure containing no twin plane. The regular crystal grains are preferably in a regular hexagonal or tetradecahedral form, and more preferably tetradecahedral from.

In the silver halide emulsion used in the invention, silver halide grains meeting the requirements regarding the proportion of the (100) face of a grain, the average iodide content, the regular crystal and specified internal grain structure, as claimed in the invention, account for at least 50%, preferably at least 70%, and more preferably at least 90% of the total grain projected area.

Silver halide grains used in the invention preferably contain dislocation lines. The number of dislocation lines per grain is preferably not less than 10, and more preferably not less than 30. The average iodide content in the region formed after introduction of the dislocation lines is preferably not more than 6 mol %, and more preferably not more than 4.5 mol %.

The dislocation lines in tabular grains can be directly observed by means of transmission electron microscopy at a low temperature, for example, in accordance with methods described in J. F. Hamilton, Phot. Sci. Eng. 11 (1967) 57 and T. Shiozawa, Journal of the Society of Photographic Science and Technology of Japan, 35 (1972) 213. Silver halide tabular grains are taken out from an emulsion while ensuring to not exert any pressure that causes dislocation in the grains, and are then placed on a mesh for electron microscopy. The sample is observed by transmission electron microscopy, while being cooled to prevent the grain from being damaged (e.g., printing-out) by the electron beam. Since electron beam penetration is hampered as the grain thickness increases, sharper observations are obtained when using an electron microscope of a high voltage type.

In the case of regular crystal grains, it is often difficult to observe electron beam transmission images due to their grain thickness. In such a case, a silver halide grain is sliced to not more than 0.25 $\mu$m thick, in the direction parallel to the (100) face, while carefully applying pressure so as not to cause dislocation so that the dislocation lines can be confirmed by observing the thus obtained slice. The presence of the dislocation lines can be estimated by the analysis method employing a half-width of powder X-ray diffraction lines.

The regular crystal grains used in the invention preferably have not less than 10 dislocation lines per grain. The number of dislocation lines per regular crystal grain is defined as the number of the dislocation lines determined when a slice of each grain, as obtained above, is observed from the (100) direction. In this case, the number of grains to observe the dislocation is to be at 300 or more. The silver halide grains used in the invention, more preferably, have not less than 30 dislocation lines per grain.

A variation coefficient of the number of dislocation lines is defined according to the following equation:

K(%) is defined as follows:

$$K(\%)=(\sigma/\alpha)\times 100$$

where $\sigma$ is a standard deviation of the number of dislocation lines per grain and $\alpha$ is an average value of the dislocation lines per grain. The variation coefficient of the number of dislocation lines is preferably not more than 30%, and more preferably not more than 20%.

The silver halide grains exhibiting the preferred variation coefficient of the number of dislocation lines can be prepared according to the following procedure. With regard to the time required for introducing the dislocation lines in the preparation of regular crystal grains according to the invention, the period from the time of starting addition of an iodide to the time of starting the growth of an outer layer adjacent to the dislocation lines is preferably not more than 10 min., and more preferably not more than 5 min in terms of uniformity in the number of the dislocation lines per grain. The pAg at the time of introducing the dislocation lines is preferably not more than 7.8 in terms of uniformity in the number of the dislocation lines per grain. To achieve uniform introduction of the dislocation lines in the grains, the crystal habit of the grains is preferably uniform, and the variation coefficient of the proportion of the (100) face among grains is preferably not more than 20%.

Introduction of the dislocation lines into silver halide grains used in the invention is started preferably at the time when 30 to 60% of the silver amount used for growing the silver halide grains (and more preferably within 40 to 70%) is consumed. The method for introducing the dislocation lines is not specifically limited, however, a method of introducing the dislocation by employing a steep gap of the silver halide lattice constant due to a steep difference in halide composition is preferred, in which a high iodide layer is formed at the time of starting the introduction of the dislocation lines and then a lower iodide layer is formed outside the high iodide layer. Preferred examples of the method for forming the high iodide include addition of an aqueous iodide (e.g., potassium iodide) solution, along with an aqueous silver salt (e.g., silver nitrate) solution by a double jet technique; addition of silver iodide fine grains; addition of an iodide solution alone and addition of a compound capable of releasing an iodide ion, and of these, the addition of silver iodide fine grains is more preferred.

The silver halide grains according to the invention may have an outermost surface layer having a thickness of 30 nm or less and a different iodide content from that of a layer adjacent thereto. The outermost layer preferably exists in the region accounting for at least 50%, and more preferably at least 70% of the total surface of the grain. The outermost layer preferably has a thickness of 10 nm or less and an iodide content of 10 mol % or less. The outermost layer preferably contains a metal ion and the metal ion is more preferably an iridium ion. The method for forming the outermost layer is not specifically limited, however, a method of allowing a layer having a different iodide content to grow after completing the grain growth is preferred. Preferred examples of the growing method include addition by double jet process and an addition of fine silver halide grains. Of these additions, an addition of fine silver halide grains of a grain size of 0.07 $\mu$m or less is preferred. The fine silver halide grains preferably contain not more than 3 mol % iodide. The fine silver halide grains contain a metal ion and the metal ion is more preferably an iridium ion. The existence of the outermost layer having a different iodide content and its thickness can be confirmed by measuring the iodide content in the direction of the depth.

The measuring method will be further described. To take silver halide grains out of a silver halide emulsion, gelatin, used as a dispersing medium, is degraded with a proteinase under a safelight and removal of supernatant by centrifugation and washing with distilled water are repeated. In cases where silver halide grains are present in a coating layer containing gelatin as a binder, the grains can be taken out in a similar manner using a proteinase. In cases where a polymeric material other than gelatin is contained therein, it can be removed by dissolving the polymeric material with an appropriate organic solvent. In cases where a sensitizing dye or dyestuff is adsorbed onto the grain surface, these materials can be removed using an alkaline aqueous solution or alcohols to produce a clean silver halide grain surface. Silver halide grains dispersed in water are coated on a conductive substrate and dried. It is preferred to arrange the grains on the substrate without causing aggregation of the grains. The thus prepared grain sample is observed using an optical microscope or a scanning electron microscope. A dispersing aid may be employed to prevent grain aggregation. The use of commonly used anionic surfactants and cationic surfactants are not preferred, which often reduce stability of the secondary ion intensity in the SIMS measurement described later. An aqueous 0.2% or less gelatin solution is preferably used as a dispersing aid. After degradation with a proteinase, a silver halide grain dispersion which has been diluted with distilled water may be coated on the conductive substrate. The conductive substrate surface which is smooth and contains no element exhibiting a high secondary ion yield, such as an alkali metal, is preferred and a mirror plane-polished, low-resistive silicon wafer exhibiting resistivity of not more than 1.0 $\Omega$ cm which has been sufficiently washed is preferably employed. A rotation drier or a vacuum freeze drier may optimally be employed to allow the grains to be arranged on the substrate without causing aggregation. It is preferred that the grains be closely arranged without overlapping. To achieve such arrangement, a rotation drier or a vacuum freeze drier may optimally be employed.

Next, a measurement apparatus will be described. To detect a trace amount of an element contained in the grains can be employed a secondary ion mass spectrometry (hereinafter, also denoted as SIMS). A multi-channel detecting system is needed, which can simultaneously detect plural kinds of the secondary ions released from the position destroyed by the primary ion, therefore, it is not preferred to employ a single channel detecting system described in Levi Setti et al., Proceeding of East & West Symposium ICPS '90. In view of the foregoing, more preferred SIMS employed in the invention is a time of freight-type secondary ion mass spectrometry (hereinafter, also denoted as TOF-SIMS).

Further, a measurement method will be described. An analysis of the grain in the direction of the thickness of the major face can be made by the TOF-SIMS using one or more ion sources. Preferably, using at least two ion sources, one of them is used for etching and the other is used for the measurement. The values of the beam current, exposure conditions, the exposure time and the primary beam scanning region are arbitrary. To detect a trace amount of an element, a high mass-resolving power is needed to prevent interference by adjacent large peaks. In the case of silicon Si (28 a.m.u.), for example, it needs to make measurement under conditions of obtaining a mass resolving power of 5,000 or more. Preferred ions for the TOF-SIMS measurement include metal ions such as $Au^+$, $In^+$ and $Ga^+$. Ions for etching are optional, including $Au^+$, $In^+$, $Ga^+$, $Cs^+$, $Ar^+$, $Xe^+$, $Ne^+$ and $O^+$. The beam current, exposure conditions, exposure time and the primary beam scanning region are to be controlled so as to obtain an analytical depth equivalent to the depth from the major face of the grain. For example, emulsions are prepared by varying the halide composition to form a covering layer using, as a host grain, giant silver bromide grains prepared by referring to J. F. Hamilton, Phil. Mag., 16, 1 (1967). Using the emulsions, the measurement of only the central portion of the grain is made based on given conditions. Thereafter, using an atomic force microscope (hereinafter, also denoted as AFM), the depth of a square crater produced in the central portion of the giant grain is measured and thereby can be determined the analytical depth corresponding to the measuring conditions and the halide composition of the respective covering layer. Any commercially available, commonly known apparatus can be employed as the AFM. It is preferred to make measurement in a contact mode using NV 2000 available from Olympus Corp., in which grains to be measured can be confirmed by an optical microscope. Observation of silver halide grains with the AFM is described in Takada: J. Soc. Photo. Sci. Tech. Japan, 158 [2] 88 (1995). Instead of using a giant grain as a host grain, a thin layer can be employed, which can be obtained by allowing silver bromide to be vapor-deposited on the cleavage plane of a rock salt heated at 300° C. under high vacuum and then dissolving the rock salt.

Exemplarily, $Cs^+$ was used as an ion source for etching and $Ga^+$ was used as an ion source for measurement. The ions for etching need to be irradiated within a broader region than the irradiation region of the ions for measurement. In this regard, Cs+ was irradiated at a 400 micro-angle for etching and Ga+ was irradiated at a 60 micro-angle for measurement. Using the $^{115}$In peak, an area intensity (peak area) was measured for every constant depth. In cases when the peak intensity is low, an area at the lower mass side to the intended peak is also measured to avoid the influence of the background and is to be subtracted from the $^{115}$In peak value to determine a true peak intensity of In. The profile in the depth direction is determined from the etching conditions (an etching rate) and the etching time, enabling confirmation of the existence of outermost layers different in the iodide content and to determine their thickness.

In cases where the dislocation lines are introduced into silver halide grains used in the invention, the average iodide content in the inner region toward the position of introducing the dislocation lines is preferably not more than 5 mol %.

The proportion of the (100) face per grain of silver halide emulsion grains can be determined by electronmicroscopic observation of the grains. Thus, at least 50% by area of the surface of a grain is preferably accounted for by a (100) face. More preferably, at least 60%, and still more preferably 70 to 95% of the grain surface is accounted for by the (100) face. The proportion of the (100) faces of the total silver halide emulsion grains can also be determined by commonly known powder X-ray diffractometry or a method employing dye absorption. Preferably, at least 50% of total grain surface area is accounted for by the (100) face.

A variation coefficient of a proportion of a (100) face of a silver halide grain, among total grains, is preferably not more than 20%, more preferably not more than 15%, and still more preferably not more than 10%. The variation coefficient can be determined in the following manner. The proportion of (100) faces of each grain can be determined in such a manner that metal is deposited from the oblique direction (i.e., shadowing treatment) and observed with SEM (Scanning Electron Microsope), after which the observed images are subjected to image processing. When subjecting grains to the shadowing treatment and observing the grains from the upper side by employing the shadow caused by the amount of metal deposited, a (100) face and a non-(100) face could be successfully distinguished. The shadowing treatment is a technique for providing a shadow as grains which has commonly been used in replica observation of silver halide grains and described in "Collective Electron Microscope Sample Technique" published by Seibundo Shinkosha, page 123 (1970).

The proportion of a (100) face of the grain can be determined according to the following procedure. To take silver halide grains out of a silver halide emulsion, gelatin used as a dispersing medium is degraded with a proteinase under a safelight, and subjected to repeated removal of supernatant by centrifugation and washing with distilled water. In cases where silver halide grains are present in a coating layer containing gelatin as a binder, the grains can be taken out in a similar manner using a proteinase. In cases where a polymeric material other than gelatin is contained therein, it can be removed by dissolving the polymeric material with an appropriate organic solvent. In cases where a sensitizing dye or dyestuff is adsorbed onto the grain surface, these materials can be removed using an alkaline aqueous solution or alcohols to produce a clean silver halide grain surface. Silver halide grains dispersed in water are coated on a conductive substrate and dried. It is preferred to arrange the grains on the substrate without causing aggregation of the grains. The thus prepared grain sample is observed using an optical microscope or a scanning electron microscope. A dispersing aid may be employed to prevent grain aggregation. After degradation with a proteinase, a silver halide grain dispersion which has been diluted with distilled water may be coated on the conductive substrate. A rotation drier or a vacuum freeze drier may optimally be employed to allow the grains to be arranged on the substrate without causing the aggregation. A conductive substrate surface which is smooth and contains no element exhibiting a high secondary ion yield, such as an alkali metal, is prefer red and a mirror plane-polish ed, low-resistive silicon wafer exhibiting resistivity of not more than 1.0 Ω cm which has been sufficiently washed is preferably employed. A smooth polyethylene terephthalate base on which carbon is thinly deposited to provide conductivity may also be used.

Onto the silver halide grains dispersed on a substrate, metal is allowed to deposit from the direction of an angle of 45°. Metals to be deposited are generally Cr and Pt-Pd and preferably are platinum carbon in terms of graininess of the deposited membrane as well as linearity of evaporation. When the metal-deposited membrane is too thin, the contrast difference necessary to distinguish the (100) face from non-(100) faces cannot be obtained. On the other hand, a thick membrane increases errors in measurement, therefore, the thickness is preferably 20 nm or so. The SEM is preferably a higher resolution apparatus to enhance measurement precision. Observation is made at an electron beam accelerating voltage of 1.8 kV, whereby a sufficient contrast difference is obtained to make easy distinction of turned-up (100) faces, external form of grains or substrate in the subsequent image processing stage. Observation is made from the upper side, without inclining the sample. Observed images are photographed using a Polaroid film or a conventional negative film and may then be read with a scanner into a computer for image processing. To prevent deterioration of such read images, it is preferred to save them as digitized images on line, connecting the SEM to a computer for image processing. The read images are then subjected to a median filter to remove impulse errors of images. Thereafter, binary-coding is made at a threshold value enabling image extraction of turned-up (100) faces and the grain contour, after which an area of each grain is measured numbering the grains. Inputting measured (100) face areas and an area within the grain contour into a text calculation software in the form of ASCII, the (100) face proportion of each grain can be determined.

As a variation coefficient of the (100) face proportion among grains, K% is defined by the following formula:

$$K(\%)=[\sigma_{(100)}/\alpha_{(100)}]\times 100$$

where $\sigma_{(100)}$ is a standard deviation (%) of a (100) face proportion and $\alpha_{(100)}$ is an average value of (100) face proportions (%).

The variation coefficient is preferably not more than 15%, and more preferably not more than 10%. Specifically, in cubic silver halide grains containing dislocation lines, it is preferred to reduce the variation coefficient of the (100) face proportion among grains. The (100) face proportion of a grain is preferably not less than 50%, and more preferably 60 to 95%. It is preferred to reduce the (100) face proportion according to the following method.

The pAg of forming cubic grains is preferably 6.8 to 7.8 in terms of stability of the face proportion. In addition, a method of supplying an iodide to a reaction mixture to grow grains is essential; the use of fine silver iodide grains or the use of an iodide releasing agent is effective for reducing the variation coefficient of the (100) face proportion among grains. This effect is supposed to result from the iodide ion distribution being made homogeneous in a mixing vessel. It is particularly important in the preparation of silver halide grains containing dislocation lines. To enhance homogeneity of the contents in the mixing vessel, it is preferred to use a means such as increasing a linear speed of stirring a solution in the mixing vessel or reducing the silver halide concentration in the mixing vessel. The stirring speed (or rotation speed) is preferably increase to the point of causing no foam. The silver halide concentration is preferably 0 to 2 mole per liter immediately before starting grain growth, 0 to 1.5 mole per liter immediately after completing grain growth and 0 to 5 mole per liter during grain growth.

Iodide ions are preferably supplied using fine silver iodide grains or an iodide ion releasing agent to reduce a variation coefficient of the (1009 face proportion distribution among grains. Examples of the iodide ion releasing agent usable in the preparation of silver halide grains are shown below, but are not limited to these.

(1)

$ICH_2COOH$ (2)

$ICH_2CONH_2$ (3)

$ICH_2CN$ (4)

$I(CH_2)_2COOH$ (5)

$I(CH_2)_3COOH$ (6)

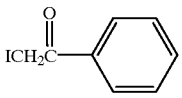

-continued (7)

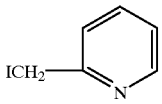

(8)

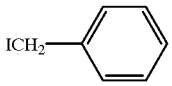

(9)

$I(CH_2)_2SO_3Na$ (10)

$I(CH_2)_2SO_2CH_3$ (11)

$I(CH_2)_2OH$ (12)

$I(CH_2)_3OH$ (13)

$I(CH_2)_4OH$ (14)

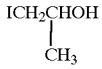

(15)

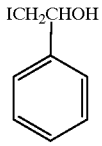

(16)

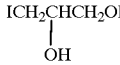

(17)

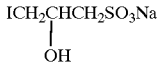

(18)

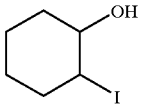

(19)

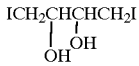

(20)

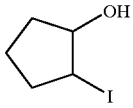

(21)

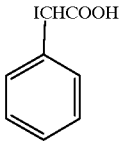

(22)

$I(CH_2)_2SO_2CH_2CONH_2$ (23)

$I(CH_2)_2NH_2$

-continued
(24) $I(CH_2)_2NHSO_2CH_3$
(25) $I(CH_2)_2NHCOCH_3$
(26) $I(CH_2)_2OCH_3$
(27) $I(CH_2)_2SCH_3$
(28)
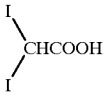
(29)
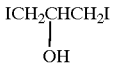
(30) $I(CH_2)_2SO_2NH_2$
(31)
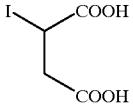
(32)
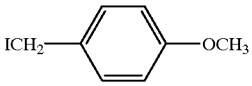
(33)
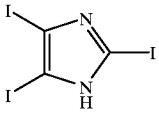
(34)
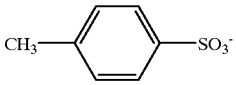
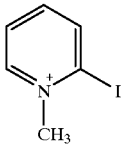
(35)
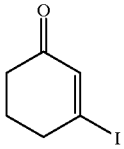
(36)
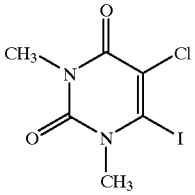
(37)
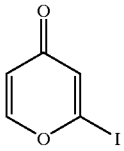
-continued
(38)
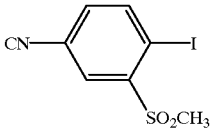
(39)
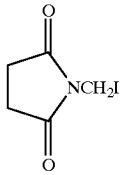
(40)
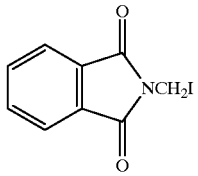
(41)
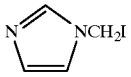
(42)
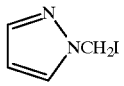
(43)
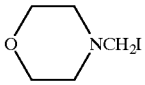
(44)
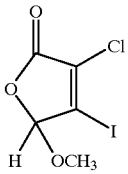
(45)
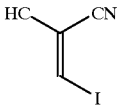
(46)
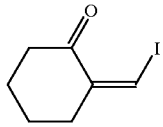
(47) $I(CH_2)_5COOH$
(48)
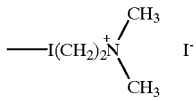
(49) $I(CH_2)_2N(CH_3)SO_2CH_3$ -continued

(50) $I(CH_2)_2OCOCH_3$

(51) $I(CH_2)_2N(CH_3)COCH_3$ (52)

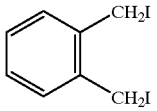

(53)

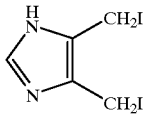

(54)

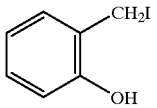

(55)

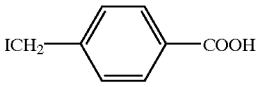

(56)

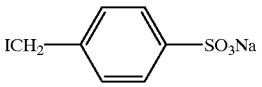

(57) $ICH_2CONH(CH_2)_2—SO_3Na$ (58)

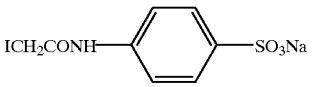

(59)

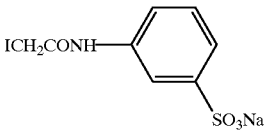

(60)

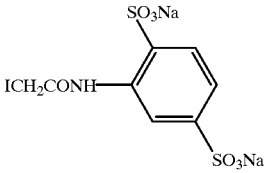

(61)

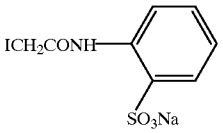

(62)

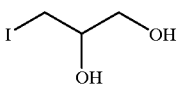

(63) $Br(CH_2)_2OH$

-continued (64)

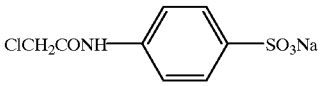

(65)

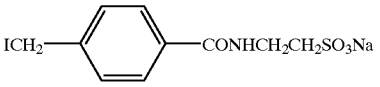

(66)

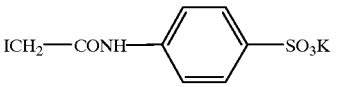

(67)

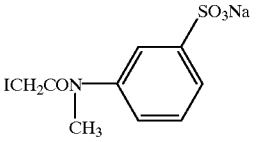

(68)

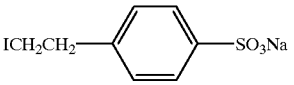

(69)

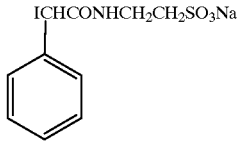

(70)

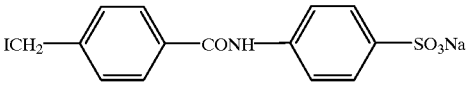

(71)

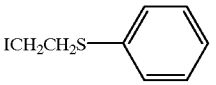

Silver halide grains used in the invention preferably, each internally includes a silver halide phase having an iodide content of not less than 7 mol % and accounting for 0.1 to 15%, more preferably 0.1 to 8%, and still more preferably 0.1 to 5% of the volume of the grain.

This high iodide containing phase of 7 mol % or more iodide (preferably 10 mol % or more iodide) is localized in a region of from 40 to 80% (preferably 40 to 60%) of silver used for growing grains. Thus the high iodide phase is in the region at a depth of 7 to 27% from the (100) surface, based on the length between the (100) face and the center of a grain. In other words, the high iodide phase is in the region R at a depth as defined below:

$$r_1 \leqq R \leqq r_2$$

wherein $r_1$ represents a position at a depth of 0.07 r from the (100) surface of the grain and $r_2$ represents a position at a depth of 0.27 r from the (100) surface, in which r is the length of a perpendicular line drawn from the center of the grain to the (100) surface. The high iodide phase is in the region at a depth of from 0.07 r to 0.27 r from the (100) face. Herein, the center of the grain is to be the center of gravity of the grain.

A method of forming the high iodide containing phase of 7 mol % or more iodide is not specifically limited. Similar to the method of introducing dislocation lines, it is preferred to allow the high iodide phase to be localized by adding an aqueous iodide (such as potassium iodide) solution and a silver salt solution by the double jet addition, adding fine silver iodide grains, adding an aqueous soluble iodide salt solution by itself or using an iodide ion releasing agent. Of these, the addition of fine silver iodide grains is more preferred.

Further, to form the high iodide containing phase, it is preferred to add the fine silver iodide grains or aqueous soluble iodide salt or iodide ion releasing agent at a time after addition 40% of a silver salt to be used for grain growth and before 80% of the silver salt during the course of grain growth.

It is preferred to form a band-formed high iodide contour within the grain by localizing the high iodide containing phase. The high iodide contour can be observed using a transmission electron microscope at a low temperature in a manner similar to the observation of dislocation lines mentioned before. Preferably, at least 50% of the total grain projected area (more preferably at least 60%, and still more preferably 80% thereof) is accounted for by grains containing the high iodide contour. The width of the contour is preferably 0.05 $\mu$m or less and more preferably 0.02 $\mu$m or less.

The iodide distribution in the high iodide contour may be uniform or non-uniform. In cases of non-uniform distribution, silver halide grains having a high iodide phase of 7 mol % or more iodide only at the position facing a (100) face, and cubic-formed silver halide grains having the high iodide phase only at the position facing a corner or edge, or a (111) or (110) surface. The iodide distribution within the grain can be determined by slicing the grain no more than 0.25 $\mu$m thick and measuring the iodide content at various positions on the slice. The position facing the (100) face, and the position facing to the corner or the edge or facing to the (111) face or (110) face are defined as follows.

Figure 2:
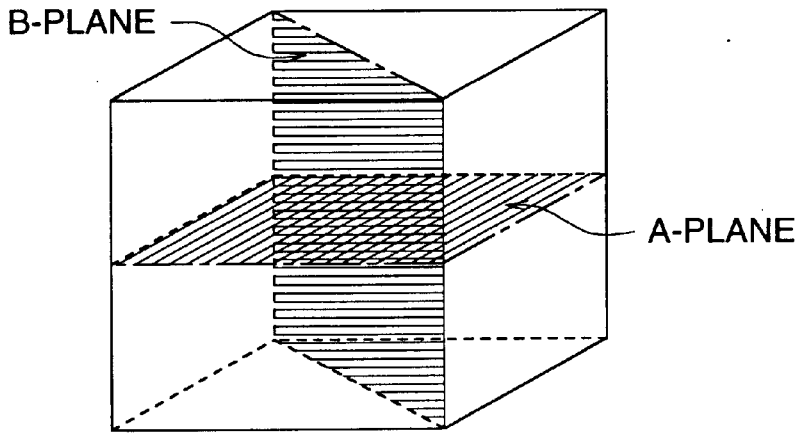
FIG. 2 illustrates sections A and B of a cubic grain.
Figure 3A:
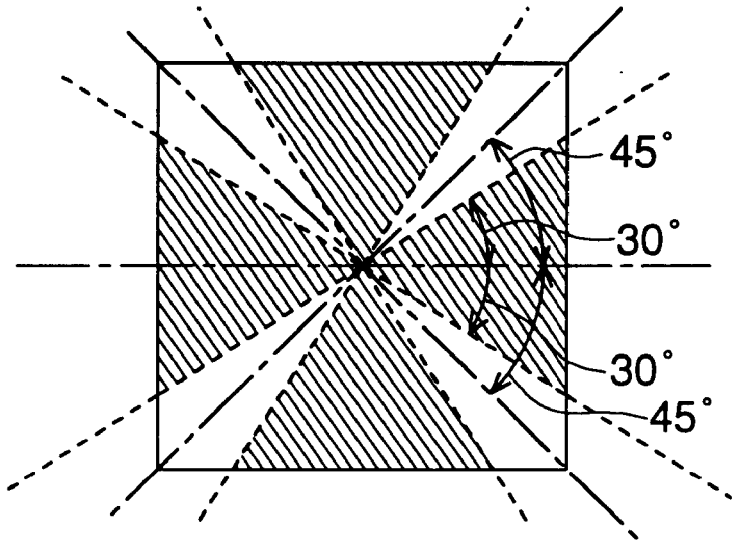
FIG. 3 also illustrates the A and B sections.

Position Facing a (100) Face:

A cubic-formed silver halide grain is sliced so as to pass through a central portion of the (100) face, as shown as A-plane in FIG. 2, and in the resulting section (FIG. 3A), the hatched region is defined as a position facing a (100) face. FIG. 4A illustrates a perspective view of an internal high iodide phase at the position facing the (100) face and at a depth of 7 to 27% from the (100) surface; and FIG. 4B shows its section.

Figure 3B:
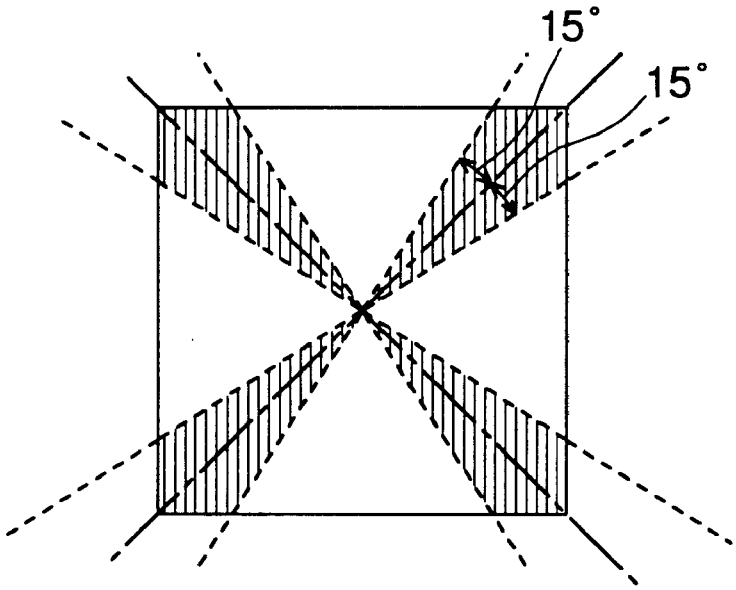
Figure 8A:
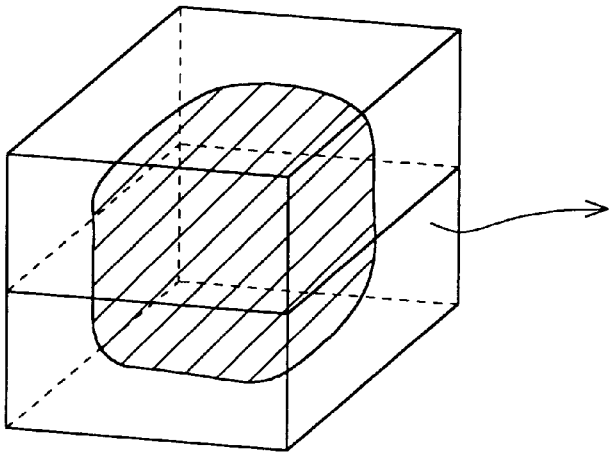
Figure 8B:
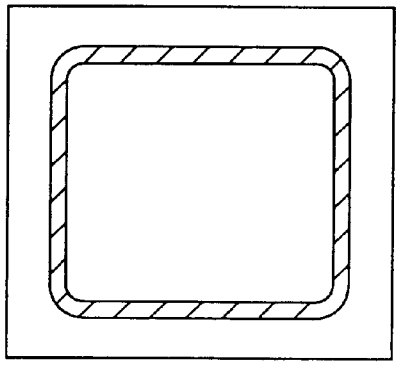

Position Facing a Corner, Edge, (111) Face or (110) Face:

A cubic-formed silver halide grains is sliced in the direction of from a corner to a corner opposite thereto, as shown in the B-plane in FIG. 3., and in its section (as shown in FIG. 4B), the hatched region and the non-hatched region each are defined as a position facing a corner, an edge, a (111) face or a (110) face. Exemplarily, FIG. 5A illustrates a perspective view of an internal high iodide phase at the position facing the corner or a (111) face and at a depth of 7 to 27% from the (100) surface; and FIG. 5B shows its section. FIG. 6A illustrates a perspective view of an internal high iodide phase at the position facing the surface having an edge or a (110) face and at a depth of 7 to 27% from the (100) surface; and FIG. 6B shows its section. FIG. 7A illustrates a perspective view of an internal high iodide phase at the position facing the surface having a corner and an edge, or a (111) face and a (110) face and at a depth of 7 to 27% from the (100) surface and FIG. 7B shows its section. FIG. 8A illustrates a perspective view of an internal high iodide phase forming a continuous phase at a depth of 7 to 27% from the (100) surface; and FIG. 8B shows its section.

Silver halide grains relating to the invention may be rounded on the corner or along the edge and may have a surface having a face index other than (100), such as a (111) or (110) face. In such a case, when the six major faces of the cubic-formed grain are extended, the intersection is defined as a corner or an edge and the position facing a (100) face, and the position facing a corner, edge, (111) face or (110) face can thereby be defined.

In cases when the region facing the (100) face has a higher iodide content, the difference in iodide content between the region facing the (100) face and other regions is preferably not less than 4 mol %, and more preferably not less than 7 mol %. In cases when the region facing the corner, edge, (111) face or (110) face has a higher iodide content, the difference in iodide content between the region facing the corner, edge, (111) face or (110) face and other regions is preferably not less than 4 mol %, and more preferably not less than 7 mol %.

As a method for enhancing the iodide content at the position facing the corner, edge, (111) face or (110) face, an iodide is added to a solution containing cubic host grains having a higher (100) face portion and the grains are allowed to grow. In this case, the (100) face portion of the grains is preferably 90% or more. Alternatively, as described in JP-A 1-40938, after forming host grains, a (100) face-adsorbing compound is added, then the iodide is added thereto and subsequently, the grains are allowed to grow. As an iodide are preferably fine silver iodide grains. As a method for enhancing the iodide content at the position facing the corner, edge, (111) face or (110) face, an iodide is added to a solution containing cubic host grains having a higher (100) face portion and the grains are allowed to grow. In this case, the (100) face portion of the grains is preferably 90% or more. Alternatively, as described in JP-A 1-40938, after forming host grains, a (100) face-adsorbing compound is added, then the iodide is added thereto and subsequently, the grains are allowed to grow. As an iodide are preferably fine silver iodide grains.

Figure 9A:
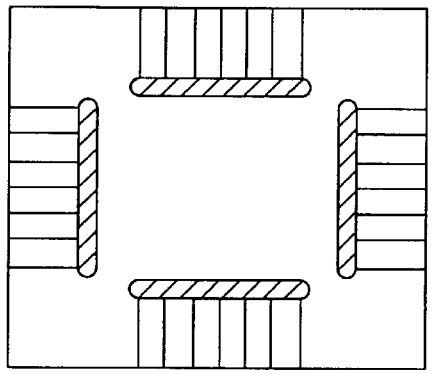
FIG. 9A through 9C illustrate orientation of dislocation lines.
Figure 9B:
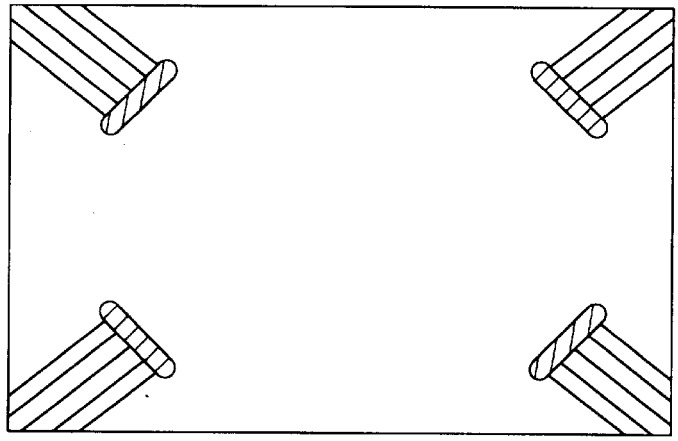

In silver halide grains used in the invention, it is preferred in terms of sensitivity that at least 60% of dislocation lines formed within the grain are oriented toward the corners, edges, (111) faces or (110) faces of the grain, as illustrated in FIG. 9B. Herein, the orientating direction, for example, in observation of dislocation lines on the sliced plane, means that the direction of the dislocation lines is oriented within +15° of the (111) direction (also denoted as <111>).

Figure 9C:
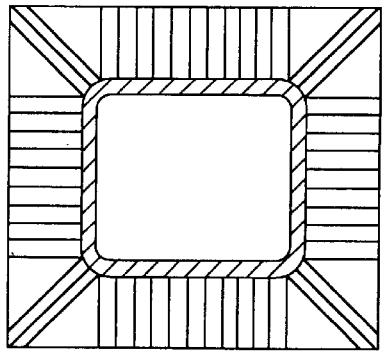
Figure 10:
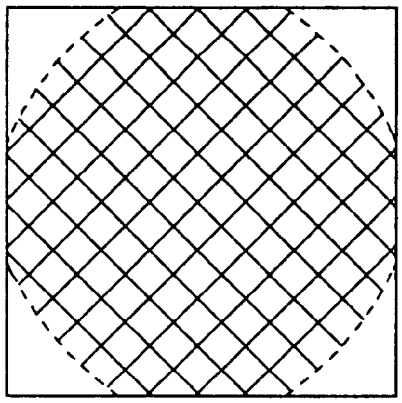
FIG. 10 illustrates an outline of the projected plane of upward-oriented (100) face of a cubic grain.
Figure 11:
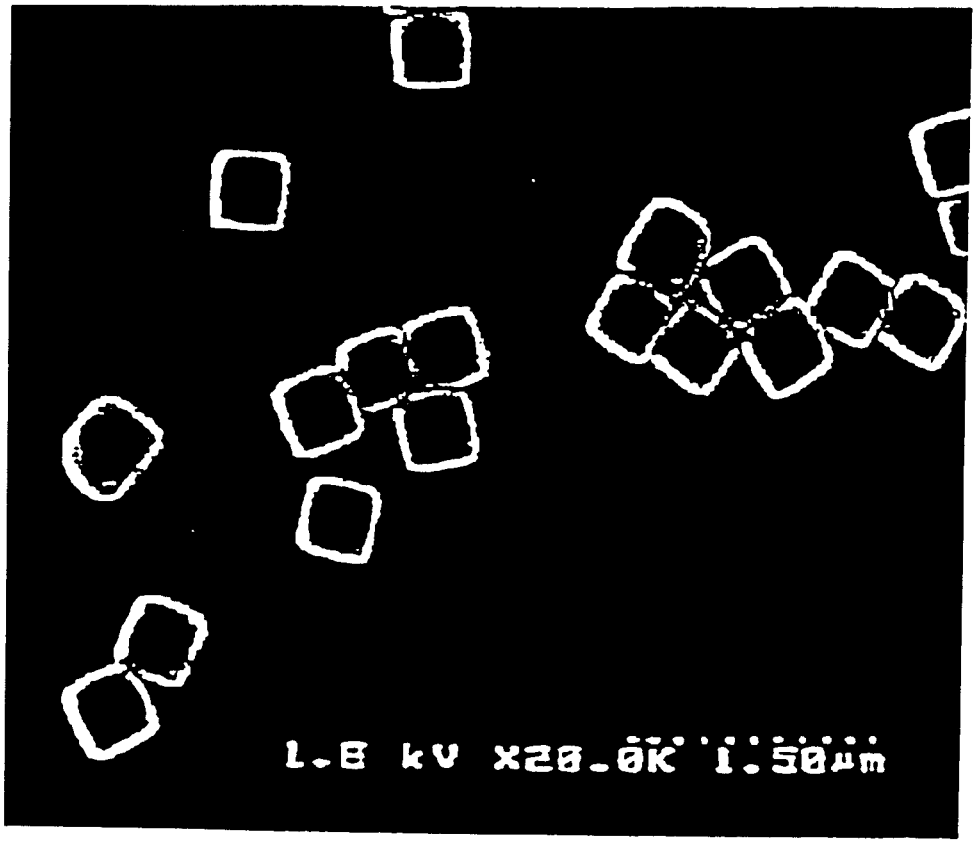
FIG. 11 is an electronmicrograph of grains exhibiting a low (100) face proportion.
Figure 12:
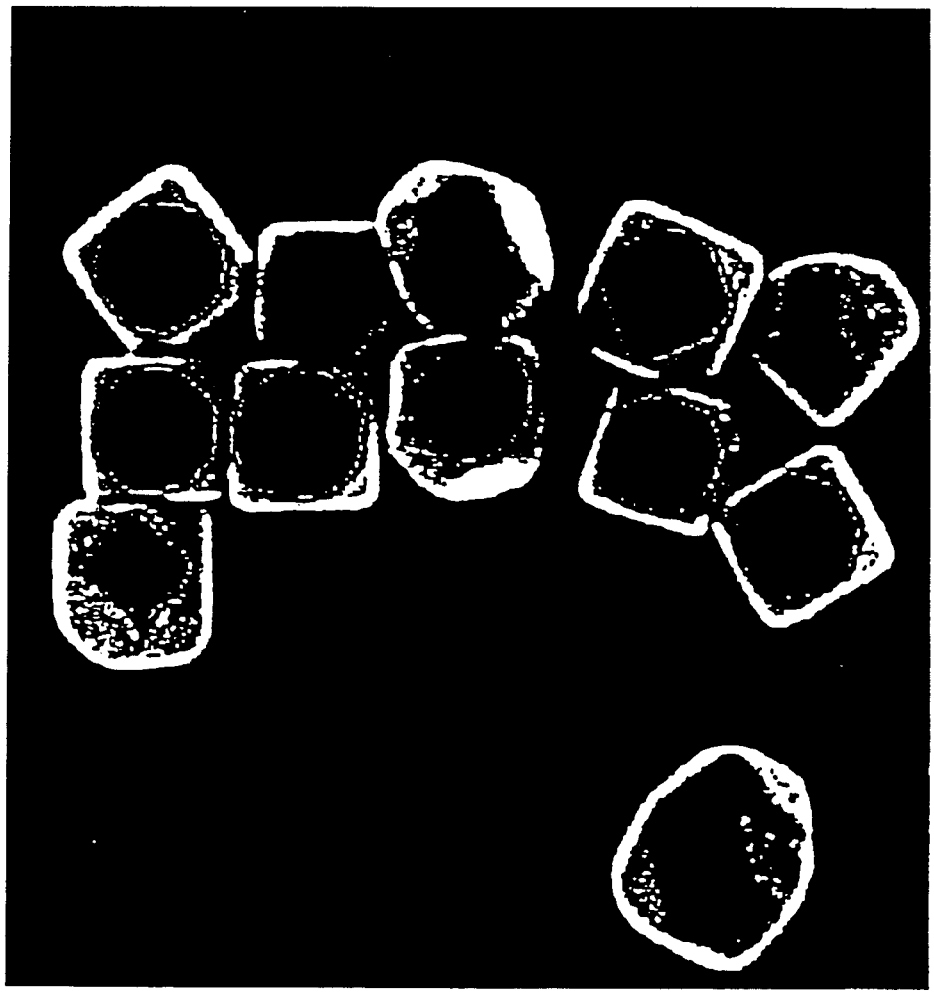
FIG. 12 is an electronmicrograph of grains exhibiting a high (100) face proportion.

It is preferred in terms of pressure resistance that at least 60% of the dislocation lines of the grain are formed in the direction substantially perpendicular to a (100) face, as illustrated in FIG. 9A. The direction substantially perpendicular to a (100) face, for example, in observation of dislocation lines on the sliced plane, means that the direction of the dislocation lines is oriented within +15° of the (100) direction. Further, FIG. 9C illustrates dislocation lines formed when a high iodide phase forms a continuous phase.

The direction and the angle of the dislocation lines can be controlled by adjusting the pAg at the time of introducing the dislocation lines or during the subsequent grain growth. Employing pAg-dependence of a grain growth rate in the (100) direction and the (111) direction, the pAg in the stage of grain growth after adding an iodide to introduce dislocation lines, can be selected to allowing the dislocation lines to grow in a given direction. The directivity can be further enhanced by combining the selectivity during grain growth described above with the use of the form of the grain and a face-selective compound.

The silver halide emulsion grains preferably contain not more than chloride and not less than 0.5 mol % (more preferably, 1 to 5 mol %) iodide. The grain size, which is represented by an equivalent edge length of a cube having an identical volume to the grain, is preferably 0.1 to 1.2 μm, and more preferably 0.15 to 0.7 μm. A variation of coefficient of grain size distribution (which is represented by a standard deviation of edge lengths, divided by an average edge length) is preferably not more than 20%, and more preferably 15%. However, the silver halide emulsion is not necessarily monodisperse. The emulsion may be blended. For example, two or more cubic grain emulsions different in grain size may be blended after grain growth, as far as the (100) face proportion meets the requirements of the invention.

The tabular grains used in the invention preferably exhibit not more than 20%, and more preferably not more than 10% of the iodide content distribution among grains, i.e., a variation coefficient of iodide content among grains (which is represented by a standard deviation of the iodide content among grains, divided by an average iodide content of the grains.

The preparation of silver halide grains relating to the invention can be made according to methods known in the art alone or in combination, as described in JP-A 61-6643, 61-146305, 62-157024, 62-18556, 63-92942, 63-151618, 63-163451, 63-220238, and 63-311244. Example thereof include simultaneous addition, a double jet method, a controlled double jet method in which the pAg of a liquid phase forming silver halide grains is maintained at a given value, and a triple jet method, in which soluble silver halides different in halide composition are independently added. Normal precipitation and reverse precipitation in which grains are formed in an environment of excessive silver ions are also applied. The pAg of the liquid phase forming silver halide grains can be controlled so as to meet the grain growth rate and this technique is preferred to prepare highly monodispersed grains. The addition rate is referred to techniques described in JP-A 54-48521 and 58-49938.

Silver halide solvents are optionally employed. Examples thereof include ammonia, thioethers and thioureas. The thioethers are referred to U.S. Pat. Nos. 3,271,157, 3,790, 387, and 3,574,628. The mixing method is not specifically limited, and neutral precipitation, ammoniacal precipitation and acidic precipitation are applied. The pH is preferably not more than 5.5, and more preferably not more than 4.5 in terms of reduced fogging of silver halide grains.

Silver halide grais are generally formed in the presence of a dispersing medium. The dispersion medium is a substance capable of forming a protective colloid, and gelatin is preferably employed. Gelatin used as the dispersing medium include an alkali processed gelatin and acid processed gelatin. Preparation of gelatin is detailed in A. Veis, The Macromolecular Chemistry of Gelatin, published Academic press, 1964. Examples of hydrophilic colloidal materials other than gelatin include gelatin derivatives, a graft polymer of gelatin and other polymer, proteins such as albumin and casein, cellulose derivatives such as hydroxyethyl cellulose, cabboxymethyl cellulose and cellulose sulfuric acid esters, saccharide derivatives such as sodium alginate and starch derivatives and synthetic polymeric materials, such as polyvinyl alcohol, polyvinyl alcohol partial acetal, poly-N-vinyl pyrrolidone, poyacrylic acid, polymethacrylic acid, polyacrylamide, polyvinyl imidazole and polyvinyl pyrazole, including their copolymers. Gelatin is preferably one which exhibits not less tan 200 of a jerry strength, defined in the PAGI method.

At the stage of forming silver halide grains, washing, chemical ripening or coating, is preferably incorporated a metal ion selected from the metals of Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb and Bi. The metal is incorporated in the form of an ammonium, acetate, nitrate sulfate, phosphate, hydroxide, or a metal complex salt such as six-coordinated complex and four-coordinated complex. Exemplary examples thereof include $Pb(NO_3)_2$, $K_2Fe(CN)_6$, $K_3RhCl_6$ and $K_4Ru(CN)_6$. A chalcogen compound may be added during the preparation of emulsions, as described in U.S. Pat. No. 3,772,031.

The silver halide grain emulsions may be subjected to desalting to remove soluble salts. Desalting can be applied at any time during the growth of silver halide grains, as described in JP-A 60-138538. Desalting can be carried out according to the methods described in Research Disclosure Vol. 176, item 17643, section II at page 23. Exemplarily, a noodle washing method in which gelatin is gelled, and a coagulation process employing an inorganic salts, anionic surfactants (e.g., polystyrene sulfonic acid) or a gelatin derivative (e.g., acylated gelatin, carbamoyl gelatin) are used. Alternatively, ultrafiltration can also be applied, as described in JP-A 8-228468.

Silver halide emulsions used in the invention can be subjected to reduction sensitization. The reduction sensitization can be performed by adding a reducing agent to a silver halide emulsion or a mixture solution used for grain growth, or by subjecting the silver halide emulsion or a mixture solution used for grain growth to ripening or grain growth, respectively, at a pAg of not more than 7 or at a pH of not less than 7. The reduction sensitization can also be performed before or after the process of chemical sensitization, as described in JP-A 7-219093 and 7-225438. The reduction sensitization may be conducted in the presence of an oxidizing agent, and preferably, a compound represented by formulas (1) to (3) described below. Preferred reducing agents include thiourea dioxide, ascorbic acid and its derivatives and stannous salts. Examples of other reducing agents include borane compounds, hydrazine derivatives, formamidinesulfinic acid, silane compounds, amines and polyamines, and sulfites. The reducing agent is added preferably in an amount of $10^{-8}$ to $10^{-2}$ mol per mol of silver halide.

To ripen at low pAg, a silver salt may be added and aqueous soluble silver salts are preferably employed, such as silver nitrate. The pAg during ripening is not more than 7, preferably not more than 6, and more preferably between 1 and 3. To ripen at high pH, an alkaline compound may be added to a silver halide emulsion or a reaction mixture solution for grain growth. Examples of the alkaline compound include sodium hydroxide, potassium hydroxide, sodium carbonate, potassium carbonate and ammonia. In the case when adding ammoniacal silver nitrate to form silver halide, alkaline compounds other than ammonia are preferably employed.

The silver salt or alkaline compound may be added instantaneously or in a given time, and at a constant flow rate or a variable flow rate. The addition may be dividedly made. Prior to the addition of aqueous soluble silver salt and/or halide, the silver salt or alkaline compound may be allowed to be present in a reaction vessel. Further, the silver salt or alkaline compound may be incorporated to an aqueous silver salt solution and added together with the aqueous soluble silver salt. Furthermore, the silver salt or alkaline compound mat be added separately from the aqueous soluble silver salt or halide.

An oxidizing agent may be added to the silver halide emulsion during the formation thereof. The oxidizing agent is a compound capable of acting on metallic silver to convert to a silver ion. The silver ion may be formed in the form of a scarcely water-soluble silver salt, such as silver halide, silver sulfide or silver selenide, or in the form of an aqueous soluble silver salt, such as silver nitrate. The oxidizing agent may be inorganic compound or an organic compound. Examples of inorganic oxidizing agents include ozone, hydrogen peroxide and its adduct (e.g., $NaBO_2.H_2O_2.3H_2O$, $2Na_2CO_3.3H_2O_2$, $Na_4P_2O_7.2H_2O_2$, $2Na_2SO_4.H_2O_2.H_2O$), peroxy-acid salt (e.g., $K_2S_2O_8$, $K_2C_2O_6$, $K_4P_2O_8$), peroxy-complex compound $\{K_2[Ti(O_2)OOCCOO].3H_2O$, $4K_2SO_4$ $Ti(O_2)OH.2H_2O$, $Na_3[VO(O_2)(OOCCOO)_2.6H_2O]\}$, oxygen acid such as permaganates (e.g., $KmnO_4$), chromates e.g., $K_2Cr_2O_7$), halogen elements such as iodine or bromine, perhalogenates (e.g., potassium periodate), high valent metal salts (e.g., potassium ferricyanate) and thiosulfonates. Examples of organic oxidizing agents include quinines such as p-quinone, organic peroxides such as peracetic acid and perbenzoic acid, and active halogen-releasing compounds (e.g., N-bromsuccimide, chloramines T, chroramine B). Of these oxidizing agents, ozone, hydrogen peroxide and its adduct, halogen elements, thiosulfonate, and quinines are preferred. Specifically, thiosulfonic acid compounds represented by the following formulas (1) to (3) are preferred, and the compound represented by formula (1) is more preferred:

$$R^1—SO_2S—M \quad (1)$$

$$R^1—SO^2S—R^2 \quad (2)$$

$$R^1SO^2S—L_nSSO_2—R^3 \quad (3)$$

where $R^1$, $R^2$ and $R^3$, which may be the same or different, represent an aliphatic group, aromatic group or a heterocyclic group; M is a cation, L id a bivalent linkage group; and n is 0 or 1. The oxidizing agent is incorporated preferably in an amount of $10^{-7}$ to $10^{-1}$ mole, more preferably $10^{-6}$ to $10^{-2}$ mole, and still more preferably $10^{-5}$ to $10^{-3}$ mole per mole of silver. The oxidizing agent may be added during grain formation, or before or during forming structure having different halide compositions. The oxidizing agent can be incorporated according to the conventional manner. For examples, an aqueous soluble compound may be incorporated in the form of an aqueous solution; an aqueous insoluble or sparingly soluble compound may be incorporated through solution in an appropriate organic solvent (e.g., alcohols, glycols, ketones, esters and amides).

Silver halide grains used in the invention may be subjected to chemical sensitization. Chalcogen sensitization with a compound containing a chalcogen such as sulfur, selenium or tellurium, or noble metal sensitization with a compound of a noble metal such as gold are performed singly or in combination.

Tabular silver halide grain emulsions used in invention are preferably subjected to selenium sensitization. Preferred selenium sensitizers are described in JP-A 9-265145. The amount of a selenium compound to be added, depending on the kind of the compound, the kind of a silver halide emulsion and chemical ripening conditions, is preferably $10^{-8}$ to $10^{-3}$ moles, and more preferably $5\times10^{-8}$ to $10^{-4}$ mole per mol of silver. The selenium compound may be added through solution in water or an organic solvent such as methanol, ethanol or ethyl acetate. It may be added in the form of a mixture with an aqueous gelatin solution. Further, it may be added in the form of a emulsified dispersion of an organic solvent-soluble polymer, as described in JP-A 4-140739. The pAg at the time of selenium sensitization is preferably 6.0 to 10.0, and more preferably 6.5 to 9.5. The pH is preferably 4.0 to 9.0, and more preferably 4.0 to 6.5; and the temperature is preferably 40 to 90° c. and more preferably 45 to 85° C. The selenium sensitization may be performed in combination with sulfur sensitization, gold sensitization, or both of them.

There can be employed sulfur sensitizers described in U.S. Pat. Nos. 1,574,944, 2,410,689, 2,278,947, 2,728,668, 3,501,313, and 3,656,955; West German Patent (OLS) 1,422,869; JP-A 55-45016, 56-24937, and 5-165135. Preferred exemplary examples thereof include thiourea derivatives such as 1,3-diphenyl thiourea, triethylthiourea and 1-ethyl-3(2-thiazolyl)thiourea; rhodanine derivatives; dithiacarbamates, polysulfide organic compounds; and sulfur single substance. The amount of the sulfur sensitizer to be added, depending on the kind of the compound, the kind of a silver halide emulsion and chemical ripening conditions, is preferably $1\times10^{-9}$ to $10^{-4}$ moles, and more preferably $1\times10^{-8}$ to $1\times0^{-5}$ mole per mol of silver.

Further, chemical sensitizers to be used in combination include noble metal salts such as platinum, paradium and rhodium, as described in U.S. Pat. Nos. 2,448,060, 2,566,245 and 2,566,263. The chemical sensitization may be carried out in the presence of thiocyanates (e.g., ammonium thiocyanate, potassium thiocyanate) or tetra-substituted thioureas (e.g., tetramethyl thiourea), which are a silver halide solvent.

The silver halide grains used in the invention may be a surface latent image type or internal latent image type, including internal latent image forming grains described in JP-A 9-222684. The silver halide grains are not specifically limited, and those which are described in RD308119, page 993, section I-A to page 995, section II. There can be used silver halide emulsions which have been subjected to physical ripening, chemical ripening and spectral sensitization. Additives used in these stages are described in RD17643, page 23, section III to page 24, section VI-M; RD18716, pages 648–649; and RD308119, page 996, section III-A to page 1,000, section VI-M. Commonly known photographic additives described in RD17643, page 25, section VIII-A to page 27, section XIII; RD18716, pages 650–651; and RD308119, page 996, section V to page 1,012, section XXI-E can also be employed. Various couplers can be employed and exemplary examples thereof are described in RD17643 page 25, section VII-C to -G and RD308119, page 1001, section VII-C to -G. The additives used in the invention can be incorporated by the dispersing method described in RD308119, page 1007, section XIV-A.

There can be employed supports described in RD17643, page 28, section XVII; RD18716, pages 647–648 and RD308119, page 1009 section XVII. Photographic materials can be provided with an auxiliary layer such as a filter layer or interlayer, as described in RD308119, page 1002, section VII-K. The photographic materials may have various layer arrangements such as conventional layer order, reverse order and unit constitution, as described in RD308119, section VII-K.

The present invention is applicable to various types of color photographic materials, including color negative films for general use or cine use, color reversal films for slide or television use, color paper, color positive films and color reversal paper.

The photographic materials used in the invention can be processed according to the methods described in RD17643, pages 28–29; RD18716, page 647 and RD308119, section XIX.

The silver halide emulsion relating to the invention preferably contains a compound represented by formula [I], {ii} or [III], as described in JP-A 8-171157.

The photographic material according to the invention may be provided with a magnetic recording layer for imputing information regarding photographic materials, such as the kind, manufacturing number, maker's name and the emulsion number; information regarding camera-photographing, such as the picture-taking date and time, aperture, exposing time, climate, picture-taking size, the kind of camera, and the use of an anamorphic lens; information necessary for printing, such as the print number, selection of filter, favorite of customers and trimming size; and information regarding customers.

The magnetic recording layer is provided on the side opposite to photographic component layers. A sublayer, an antistatic layer (conductive layer), a magnetic recording layer and a lubricating layer are preferably provided on the support in this order. As fine magnetic powder are employed metal magnetic powder, iron oxide magnetic powder, Co-doped iron oxide magnetic powder, chromium dioxide magnetic powder and barium ferrite magnetic powder. The magnetic powder can be manufactured according to the known manner.

The optical density of the magnetic recording layer is desirably as low as possible, in terms of influence on photographic images, and is preferably not more than 1.5, more preferably not more than 0.2, and still more preferably not more than 0.1. The optical density can be measured using SAKURA densitometer PDA-65 (available from Konica Corp.). Thus, using a blue light-transmitting filter, light at a wavelength of 436 nm is allowed to enter perpendicular to the coating layer and light absorption due to the coating can be determined.

The magnetic susceptibility of the magnetic recording layer is preferably not less than $3\times10^{-2}$ emu per $m^2$ of photographic material. The magnetic susceptibility can be determined using a sample-vibrating type flux meter VSM-3, available from TOEI KOGYO in such a manner that after saturating a coating sample with a given volume in the coating direction by applying an external magnetic field of 1,000 Oe, the flux density at the time of allowing the external field to be decreased to 0, is measured and converted to the volume of the magnetic layer contained in 1 m2 of the photographic material. When the magnetic susceptibility per $m^2$ of the transparent magnetic layer is less than $3\times10^{-2}$ emu, there occur problems in input and output of magnetic recording.

The thickness of the magnetic recording layer is preferably between 0.01 and 20 $\mu$m, more preferably 0.05 and 15 $\mu$m, and still more preferably 0.1 and 10 $\mu$m. As a binder of the magnetic recording layer are preferably employed vinyl type resin, urethane type resin and polyester type resin. It is also preferred to form a binder by coating an aqueous emulsion resin without the use of an organic solvent. The binder can be hardened by a hardener, thermal means or electron beam to adjust physical properties. Specifically, hardening with a polyisocyanate type hardener is preferred. An abrasive can be contained in the magnetic recording layer for preventing clogging, and non-magnetic metal oxide particles, such as alumina fine particles are preferably employed.

Support of the photographic material include polyester films such as polyethylene terephthalate (PET) and polyethylene naphthalate (PEN), cellulose triacetate film, cellulose diacetate film, polycarbonate film, polystyrene film and polyolefin film. In particular, a high moisture containing polyester support is superior in recovery of roll-set curl after processing even when the support is thinned, as described in JP-A 1-24444, 1-291248, 1-298350, 2-89045, 2-93641, 2-181749, 2-214852, and 2-291135. In the invention, Pet and PEN are preferably employed as a support. The thickness thereof is preferably between 50 and 100 $\mu$m, and more preferably 60 to 90 $\mu$m.

The photographic material according to the invention preferably has a conductive layer containing a metal oxide particles, such as ZnO, $V_2O_5$, $TiO_2$, $SnO_2$, $Al_2O_3$, $In_2O_3$, $SiO_2$, MgO, BaO or $MoO_3$. The metal oxide particles containing a small amount of oxygen deficiency or a hetero atom forming a donor to the metal oxide, which is high conductive, preferably employed. Specifically, the latter, which does not provide fog to the silver halide emulsion, is preferred.

Binders used in the conductive layer or a sublayer are the same as those used in the magnetic recording layer.

As a lubricating layer provided on the magnetic recording layer is coated a higher fatty acid ester, a higher fatty acid amide, polyorganosiloxane, a liquid paraffin or a wax.

In cases where the photographic material according to the invention is employed as a roll-formed color photographic camera material, not only miniaturization of a camera or patrone is achieved, but saving of natural resource is also possible. Since storage space for a negative film is small, the width of the film is 20 to 35 mm, and preferably 20 to 30 mm. If the photographing picture area is within the range of 300 to 700 $mm^2$, preferably, 400 to 600 $mm^2$, small format becomes possible without deteriorating image quality of a final photographic print, leading to further miniaturization of patrone and camera. The aspect ratio of a photographic image area is not limited and various types are employed, such as conventional 126 size of 1:1, a half-size of 1:1.4, 135 (standard) size of 1:1.5, hi-vision type of 1:1.8 and panorama type of 1:3.

When the photographic material according to the invention is used in a roll form, it is preferably contained in a cartridge. The most popular cartridge is a 135 format patrone. There are also employed cartridges proposed in Japanese Utility Model Application Opened to Public Inspection No. 58-67329 and 58-195236; JP-A 58-181035 and 58-182634; U.S. Pat. No. 4,221,479; JP-A 1-231045, 2-170156, 2-199451, 2-124564, 2-201441, 2-205843, 2-210346, 2-2114432-214853, 2-264248, 3-37645 and 3-37646; U.S. Pat. Nos. 4,846,418, 4,848,693 and 4,832,275. It is possible ally to "small-sized photographic roll film patrone and film camera" disclosed in JP-A 5-210201.

The silver halide emulsions according to the invention are effective specifically in processing for reversal films.

EXAMPLES

The present invention will be described based on examples, but embodiments of the invention are not limited to these examples.

Example 1

Preparation of Seed Emulsion N-1

To 500 ml of an aqueous 2% gelatin solution maintained at 40° C. were added 250 ml of an aqueous 4N silver nitrate solution and 250 ml of an aqueous potassium bromide and potassium iodide solution (molar ratio of KBr:KI=98:2) by the double jet addition, according to the method described in JP-A 50-45437, over a period of 35 min., while the pAg and pH were maintained at 9.0 and 2.0, respectively. After the resulting emulsion was adjusted to a pH of 5.5 with an aqueous calcium carbonate solution, a 364 ml aqueous solution of 5% DEMOL N (available from Kao-Atlas Corp.) and 244 ml of an aqueous magnesium sulfate solution were added thereto. After being allowed to stand for sedimentation, supernatant liquid was decanted and 1400 ml distilled water was added and dispersed. A 36.4 ml aqueous 20% magnesium sulfate solution was added to cause coagulation, the supernatant was decanted and an aqueous solution containing 28 g ossein gelatin was added to make a total volume of 425 ml. After stirring at 40° C. for a period of 40 min., seed emulsion N-1 was obtained. Electron microscopic observation revealed that the seed emulsion was comprised of monodisperse seed grains having an average size of 0.093 μm.

Preparation of Fine Silver Iodide Grain Emulsion N-2

The To 5 liters of a 6.0 wt. % gelatin solution containing 0.06 mol of potassium iodide, an aqueous solution containing 7.06 mol of silver nitrate and an aqueous solution containing 7.06 mol of potassium iodide, 2 liters of each were added over a period of 10 min., while the pH was maintained at 2.0 using nitric acid and the temperature was maintained at 40° C. After completion of grain formation, the pH was adjusted to 6.0 using a sodium carbonate aqueous solution. The finished weight was 12.53 kg. Electron microscopic observation revealed that the resulting emulsion was comprised of fine silver iodide grains having an average diameter of 0.05 μm.

Preparation of Emulsion Em-1

Emulsion Em-1 was prepared using the following solutions.

| Solution Gr-1 | |
|---|---|
| Ossein gelatin | 161.1 g |
| 10 wt % surfactant (EO-1) methanol solution | 3.0 ml |
| Seed emulsion N-1 | 97.7 ml |
| Distilled water to make | 4.2 lit. |
| EO-1: $HO(CH_2CH_2O)m(CH(CH_3)CH_2O)_{19.8}(CH_2CH_2O)nH$ | (m + n = 9.77) |
| **Solution B-1** | |
| Silver nitrate | 3560.9 g |
| Distilled water to make | 5.988 lit. |
| **Solution B-2** | |
| Potassium bromide | 2857.2 g |
| Potassium iodide | 81.34 g |
| Distilled water to make | 7.0 lit. |

To solution Gr-1 with stirring at 70° C., solutions B-1 and B-2 were added by the double jet addition at a flow rate so that nucleus grains were not formed, while the pAg was maintained at 7.3 with an aqueous 1.75N potassium bromide solution and the pH was maintained at 4.0 with an aqueous acetic acid solution. After adding solution B-1, an aqueous 3.5N potassium bromide solution was added to adjust the pAg to 9.1 and after stirring further for 2 min, the emulsion was desalted according to the method described in JP-A 5-72658. Thereafter, gelatin was added and dispersed, and the pH and pAg at 40° were adjusted to 5.80 and 8.06, respectively. The thus prepared emulsion was denoted as Em-1. From electron micrographs of the resulting emulsion, it was proved that the emulsion was comprised of cubic silver halide grains having an average edge length of 0.42 μm, exhibiting a variation coefficient of an edge length of 14%. No dislocation line was observed within the grains.

Preparation of Emulsion Em-2

Emulsion Em-2 was prepared in the same manner as in Em-1, except that the pAg was maintained at 7.7 during grain growth. The resulting emulsion was comprised of cubic-formed, tetradecahedral-like grains having an average edge length of 0.42 μm, exhibiting a variation coefficient of an edge length of 17%. No dislocation line was observed within the grains.

Preparation of Emulsion Em-3

To solution Gr-1 with stirring at 70° C., solution B-1, solution B-3 and silver iodide fine grain emulsion N-2 were added at a flow rate so that nucleus grains were not formed, while the pAg was maintained at 7.3 with an aqueous 1.75N potassium bromide solution and the pH was maintained at 4.0 with an aqueous acetic acid solution. During the addition, the flow rate was so controlled that a molar ratio of bromide ions supplied from the solution B-3 to iodide ions supplied from the emulsion N-2 was kept to be 98:2. After adding solution B-1, an aqueous 3.5N potassium bromide solution was added to adjust the pAg to 9.1 and after stirring further for 2 min, the emulsion was desalted in a manner similar to Em-1. Thereafter, gelatin was added and dispersed, and the pH and pAg at 40° C. were adjusted to 5.80 and 8.06, respectively. The thus prepared emulsion was denoted as Em-3. From electron micrographs of the resulting emulsion, it was proved that the emulsion was comprised of cubic silver halide grains having an average edge length of 0.42 μm, exhibiting a variation coefficient of an edge length of 14%. No dislocation line was observed within the grains.

| Solution B-3 | |
|---|---|
| Potassium bromide | 2915.5 g |
| Distilled water to make | 7.0 lit. |

According to the method afore-mentioned, the thus prepared emulsion each were measured with respect to the (100) face proportion of the total emulsion grains and a variation coefficient of the (100) face proportion among the grains. Results thereof are shown in Table 1.

TABLE 1

| Emulsion | Grain Size (μm) | (100) Proportion | Variation Coefficient of (100) Proportion |
|---|---|---|---|
| Em-1 (Comp.) | 0.42 | 0.77 | 15.2 |
| Em-2 (Comp.) | 0.42 | 0.61 | 24.2 |
| Em-3 (Comp.) | 0.42 | 0.74 | 12.3 |

To each of the emulsions Em-1, Em-2 and Em-3 were added sensitizing dyes (S-1 and S-2), potassium thiocyanate, chloroauric acid, sodium thiosulfate and triphenylphosphine selenide and chemical sensitization was conducted so as to give the optimum speed-granularity relationship. Subsequently, to each of the emulsion, a stabilizer (ST-1) and antifoggants (AF-1 and AF-2) were added in amounts of 1 g. 3 mg and 20 mg per mol of silver halide, respectively. Further thereto, a coupler (C-1) dispersion and photographic adjuvants such as a coating aid and a hardener were added to prepare a coating solution. The coating solution was coated on a subbed triacetate cellulose film support and dried to obtain photographic material sample 101 102 or 103.

ST-1: 4-hydroxy-6-methyl-1,3,3a,7-tetrazaindene

AF-1: 1-phenyl-5-mercaptotetrazole

AF-2: 1-(4-carboxy)phenyl-5-mercaptotetrazole

S-1

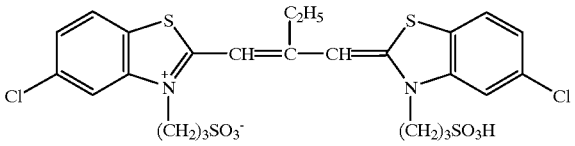

S-2

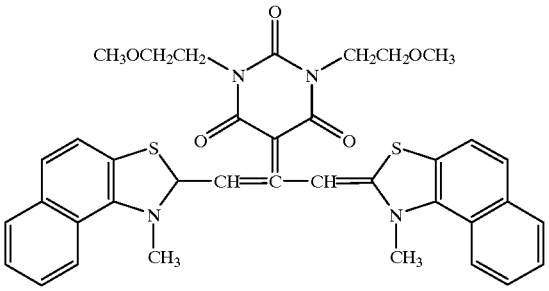

C-1

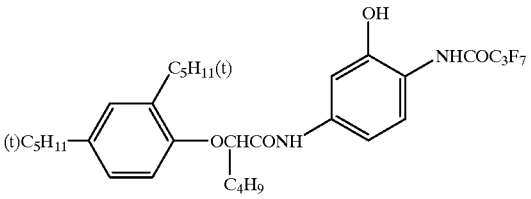

Samples each were exposed through TOSHIBA Glass Filter 0–56 and optical wedge for 1/100 sec., using a light source of 5400°K, processed according to the steps as shown below, and evaluated with respect to sensitivity, contrast and process stability.

Sensitivity

Sensitivity was represented by a relative value of a reciprocal of exposure necessary to give a color density of 1.0, based on the sensitivity of Sample 101 being 100.

Contrast (G)

Contrast G was defined as a value of a color density at 1/10 of an exposure giving a color density of 0.5, subtracted by 0.5. The contrast was represented by a relative value, based on the G of Sample 101 being 1. The larger G exhibits the higher contrast emulsion.

Process Stability

Process stability was evaluated in terms of $\Delta G=G_2/G_1$, where $G_1$ and $G_2$ each were a contrast obtained by using a first developer with a pH of 9.6 and 9.2, respectively. The $\Delta G$ is the closer to 1, the smaller variation in contrast with respect to the process variation.

| Processing Step | Temperature | Time |
|---|---|---|
| First developing | 4 min. | 38° C. |
| Washing | 2 min. | 38° C. |
| Reversal | 2 min. | 38° C. |
| Color developing | 6 min. | 38° C. |
| Adjusting | 2 min. | 38° C. |
| Bleaching | 6 min. | 38° C. |

-continued

| Processing Step | Temperature | Time |
|---|---|---|
| Fixing | 4 min. | 38° C. |
| Washing | 4 min. | 38° C. |
| Stabilizing | 1 min. | Ord. temp. |
| Drying | | |

Processing solutions used in the above steps are as follows.

First Developer Solution

| | |
|---|---|
| Sodium tetrapolyphosphate | 2 g |
| Sodium sulfite | 20 g |
| Hdroquinone monosulfate | 30 g |
| Sodium carbonate (monohydrate) | 30 g |
| 1-Phenyl-4-methyl-4-hydroxymethyl-3-pyrazolidone | 2 g |
| Potassium bromide | 2.5 g |
| Potassium thiocyanate | 1.2 g |
| Potassium iodide (0.1% solution) | 2 ml |
| Water was added to make 1000 ml (and pH of 9.60). | |
| Reversal Solution | |
| Hexasodium nitrilotrimethylene phosphonate | 3 g |
| Stannous chloride (dihydrate) | 1 g |
| p-Aminophenol | 0.1 g |
| Sodium hydroxide | 8 g |
| Glacial acetic acid | 15 ml |
| Water to make 1000 ml (pH of 5.75) | |
| Color Developer Solution | |
| Sodium tetrapolyphosphate | 3 g |
| Sodium sulfite | 7 g |
| Sodium tertiary phosphate (dihydrate) | 36 g |
| Potassium bromide | 1 g |
| Potassium iodide (0.1% solution) | 90 ml |
| Sodium hydroxide | 3 g |
| Citrazinic acid | 1.5 g |
| N-ethyl-N-(β-methanesulfonamidoethyl)-3-methyl-4-aminoaniline sulfate | 11 g |
| 2,2-Ethylendithioethanol | 1 g |
| Water to make 1000 ml (pH of 11.70) | |
| Conditioner | |
| Sodium sulfite | 12 g |
| Sodium ethylenediaminetertaacetate (dihydrate) | 8 g |
| Thioglycerin | 0.4 g |
| Glacial acetic acid | 3 ml |
| Water to make 1000 ml (pH of 6.15) | |
| Bleaching Solution | |
| Sodium ethylenediaminetertaacetate (dihydrate) | 2 g |
| Ammonium ferric ethylenediaminetertaacetate (dihydrate) | 120 g |
| Potassium bromide | 100 g |
| Water to make 1000 ml (pH of 5.56) | |
| Fixer Solution | |
| Ammonium thiosulfate | 80 g |
| Sodium bisulfite | 5 g |
| Water to make 1000 ml (pH of 6.60) | |
| Stabilizer Solution | |
| Formalin (37 wt %) | 5 ml |
| KONIDUCKS (available from Konica Corp.) | 5 ml |
| Water to make 1000 ml (pH of 7.00) | |

Results are shown in Table 2.

TABLE 2

| Sample | Emulsion | Sensitivity | Contrast | ΔG |
|---|---|---|---|---|
| 101 | Em-1 (Inv.) | 100 | 1 | 0.88 |
| 102 | Em-2 (Comp.) | 93 | 0.92 | 0.77 |
| 103 | Em-3 (Inv.) | 100 | 0.98 | 0.93 |

As apparent from Table 2, inventive emulsions exhibited high sensitvity and high contrast and little variation when subject to different developments. As can be seen from Tables 1 and 2, these characteristics were related to the (100) face proportion and its variation coefficient among Example 2

Preparation of Emulsion Em-4

Emulsion Em-4 was prepared using the following solution.

Solution Gr-1

The same composition as used in Examples 1

| | |
|---|---|
| Solution B-3 | |
| Potassium bromide | 2915.5 g |
| Distilled water to make | 7.0 lit. |
| Solution B-4 | |
| Silver nitrate | 3488.9 g |
| Distilled water to make | 5.867 lit. |
| Solution B-5 | |
| Silver iodide fine grain emulsion N-2 | 752.1 g |

To solution Gr-1 with stirring at 70° C., solutions B-3 and B-4 were added by the double jet addition at a flow rate so that nucleus grains were not formed, while the pAg was maintained at 7.3 with an aqueous 1.75N potassium bromide solution and the pH was maintained at 4.0 with an aqueous acetic acid solution. When 3.869 lit. of Solution B-4 was added, addition of Solutions B-3 and B-4 was interrupted and after stirring for 1 min., Solution B-5 was added at a constant flow rate for a period of 2 min. Then, after stirring for 1 min., Solution B-3 and B-4 were again added at a flow rate so that nucleus grains were not formed, while the pAg was maintained at 7.3 with an aqueous 1.75N potassium bromide solution and the pH was maintained at 4.0 with an aqueous acetic acid solution. After completing addition of Solution B-4, the pAg was adjusted to 9.1 with an aqueous 3.5N potassium bromide solution and after stirring further for 2 min, the emulsion was desalted in a manner similar to Em-1. Thereafter, gelatin was added and dispersed, and the pH and pAg at 40° C. were adjusted to 5.80 and 8.06, respectively. The thus prepared emulsion was denoted as Em-4. From electron micrographs of the resulting emulsion, it was proved that the emulsion was comprised of cubic silver halide grains having an average edge length of 0.42 μm, exhibiting a variation coefficient of an edge length of 14% and having an average iodide content of 2 mol %, as shown in Table 3; and ca. 70% of the total grain projected area was accounted for by grains having a (100) face proportion of 50% or more and exhibiting a variation coefficient of the (100) face proportion among grains of 13%. Further, the grains had a silver halide phase containing 15 mol % iodide and accounting for 13% of the grain volume in the region of 67 to 80%, based on silver to be used for grain growth from the grain center, i.e., in the region at a depth of 7 to 13% from the (100) face. Further, from electron micrographs of an ultra-thin slice of the grain, the grains were shown to contain dislocation lines.

Preparation of Emulsion Em-5

Emulsion Em-5 was prepared in the same manner as in Em-4, except that the pAg was maintained at 7.7 during addition of Solutions B-3 and B-4. The resulting emulsion was comprised of cubic-formed grains having an average edge length of 0.42 μm, exhibiting a variation coefficient of an edge length of 17% and having an average iodide content of 2 mol %; and ca. 70% of the total grain projected area was accounted for by grains having a (100) face proportion of 50% or more and exhibiting a variation coefficient of the (100) face proportion among grains of 13%. Further, the grains had a silver halide phase containing 15 mol % iodide and accounting for 13% of the grain volume in the region of 67 to 80%, based on silver to be used for grain growth from the grain center, i.e., in the region at a depth of 7 to 13% from the (100) face. The grains appeared to be closer to a tetradecahedral form than Em-4. Further, from electron micrographs of an ultra-thin slice of the grain, the grains contained dislocation lines.

Preparation of Emulsion Em-6

To solution Gr-1 with stirring at 70° C., Solutions B-3 and B-4 and silver iodide fine grain emulsion N-2 were added at a flow rate so that nucleus grains were not formed, while the pAg was maintained at 7.3 with an aqueous 1.75N potassium bromide solution and the pH was maintained at 4.0 with an aqueous acetic acid solution. During the addition, the flow rate was so controlled that a molar ratio of bromide ions supplied from the solution B-3 to iodide ions supplied from the emulsion N-2 was kept to be 98:2. When 3.869 lit. of Solution B-4 was added, addition of Solutions B-3, B-4 and N-2 was interrupted and after stirring for 1 min., Solution B-5 was added at a constant flow rate for a period of 2 min. Then, after stirring for 1 min., Solution B-3, B-4 and N-2 were again added at a flow rate so that nucleus grains were not formed, while the pAg was maintained at 7.3 with an aqueous 1.75N potassium bromide solution and the pH was maintained at 4.0 with an aqueous acetic acid solution. After completing addition of Solution B-4, the pAg was adjusted to 9.1 with an aqueous 3.5N potassium bromide solution and after stirring further for 2 min, the emulsion was desalted in a manner similar to Em-1. Thereafter, gelatin was added and dispersed, and the pH and pAg at 40° C. were adjusted to 5.80 and 8.06, respectively. The thus prepared emulsion was denoted as Em-6. From electron micrographs of the resulting emulsion, it was proved that the emulsion was comprised of cubic silver halide grains having an average edge length of 0.42 μm, exhibiting a variation coefficient of an edge length of 14% and having an average iodide content of 2 mol %; and ca. 70% of the total grain projected area was accounted for by grains having a (100) face proportion of 50% or more and exhibiting a variation coefficient of the (100) face proportion among grains of 13%. Further, the grains had a silver halide phase containing 15 mol % iodide and accounting for 13% of the grain volume in the region of 67 to 80%, based on silver to be used for grain growth from the grain center, i.e., in the region at a depth of 7 to 13% from the (100) face. Further, from electron micrographs of an ultra-thin slice of the grain, the grains contained dislocation lines.

According to the method afore-mentioned, the thus prepared emulsion each were measured with respect to a proportion of (100) face of the emulsion grains and a variation coefficient of the (100) face proportion among the grains. Results thereof are shown in Table 3.

TABLE 3

| | High Iodide Phase | | | (100) Grain | |
|---|---|---|---|---|---|
| Emulsion | Position (%)*2 | Volume (%)*3 | I (mol %) | Proportion (%)*1 | Remark |
| Em-4 | 7-13 | 13 | 15 | 70 | Inv. |
| Em-5 | 7-13 | 13 | 15 | 65 | Inv. |
| Em-6 | 7-13 | 13 | 15 | 75 | Inv. |

*1Proportion of regular crystal grains exhibiting a proportion of a (100) face per grain of at least 50%, based on the total grain projected area;
*2Depth from (100) face, based on the length between the grain center and the (100) face; and
*3Percentage, based on grain volume.

To each of the emulsions Em-4, Em-5 and Em-6 were added sensitizing dyes (S-1 and S-2), potassium thiocyanate, chloroauric acid, sodium thiosulfate and triphenylphosphine selenide and chemical sensitization was conducted so as to give the optimum speed-granularity relationship. Subsequently, to each of the emulsion, a stabilizer (ST-1) and antifoggants (AF-1 and AF-2) were added in amounts of 1 g. 3 mg and 20 mg per mol of silver halide, respectively. Further thereto, a coupler (C-1) dispersion and photographic adjuvants such as a coating aid and a hardener were added to prepare a coating solution. The coating solution was coated on a subbed triacetate cellulose film support and dried to obtain photographic material sample 201, 202 or 203.

Samples each were exposed through TOSHIBA Glass Filter 0–56optical wedge for 1/100 sec., using a light source 5400°K, processed, and evaluated in a manner similar to with respect to sensitivity, contrast and process stability. Sensitivity was represented by a relative value, based on the sensitivity of Sample 2-1 being 100. Contrast was represented by relative value, based on the contrast of Sample 201 being 100. Similarly to Example 1, tThe process was evaluated in terms of .G=$G_{12}/G_{11}$, where $G_{11}$ and $G_{12}$ each were a contrast obtained by using a first developer with a pH of 9.6 and 9.2, respectively. Results thereof are shown in Table 4.

TABLE 4

| Sample | Emulsion | Sensitivity | Contrast | ΔG |
|---|---|---|---|---|
| 201 | Em-4 (Inv.) | 143 | 0.98 | 0.85 |
| 202 | Em-5 (Inv.) | 125 | 0.76 | 0.63 |
| 203 | Em-6 (Inv.) | 133 | 0.93 | 0.88 |

A apparent from Table 4, introduction of dislocation lines led to enhanced sensitivity but resulted in lowered contrast and increased process variation. However, inventive emulsion which exhibited smaller variation coefficient of the (100) proportion among grains, achieved higher sensitivity, while preventing deteriorations in photographic performance.

Example 3

Preparation of Emulsion Em-7

Emulsion Em-7 was prepared using the following solutions.

| | |
|---|---|
| Solution Gr-1 | |
| Ossein gelatin | 161.1 g |
| 10 wt % surfactant (EO-1) methanol solution | 3.0 ml |
| Seed emulsion N-1 | 97.7 ml |
| Distilled water to make | 4.2 lit. |
| Solution C-1 | |
| Silver nitrate | 3560.9 g |
| Distilled water to make | 5.988 lit. |
| Solution C-2 | |
| Potassium bromide | 2798.9 g |
| Potassium iodide | 162.7 g |
| Distilled water to | 7.0 lit. |

To solution Gr-1 with stirring at 70° C., Solutions C-1 and C-2 were added by the double jet addition at a flow rate so that nucleus grains were not formed, while the pAg was maintained at 7.3 with an aqueous 1.75N potassium bromide solution and the pH was maintained at 4.0 with an aqueous acetic acid solution. When 3.869 lit. of Solution C-1 was added, the pAg was adjusted to 7.6 with an aqueous 1.75N potassium bromide solution and then Solution C-1 and C-2 were again added at a flow rate so that nucleus grains were not formed, while the pAg was maintained at 7.3 with an aqueous 1.75N potassium bromide solution and the pH was maintained at 4.0 with an aqueous acetic acid solution. After completing addition of Solution B-4, the pAg was adjusted to 9.1 with an aqueous 3.5N potassium bromide solution and after stirring further for 2 min, the emulsion was desalted in a manner described in JP-A 5-72658. Thereafter, gelatin was added and dispersed, and the pH and pAg were adjusted to 5.80 and 8.06 at 40° C., respectively. The thus prepared emulsion was denoted as Em-7. From electron micrographs of the resulting emulsion, it was proved that the emulsion was comprised of cubic-formed, tetradecahedral-like silver halide grains having an average edge length of 0.42 μm, exhibiting a variation coefficient of an edge length of 13% and having an average iodide content of 4 mol %; and about 70% of the total grain projected area was accounted for by grains having a (100) face proportion of 50% or more and a variation coefficient of the (100) face proportion among grains of 33%.

Preparation of Emulsion Em-8

EmulsionEm-8 was prepared in the same manner as in Em-7, except that the pAg was maintained at 7.3 at the time of starting addition of Solution C-1 to completion of the addition of C-1. From electron micrographs of the resulting emulsion, it was proved that the emulsion was comprised of cubic silver halide grains having an average edge length of 0.42 μm, exhibiting a variation coefficient of an edge length of 9% and having an average iodide content of 4 mol %; and about 93% of the total grain projected area was accounted for by grains having a (100) face proportion of 50% or more and a variation coefficient of the (100) face proportion among grains of 13%.

Preparation of Emulsion Em-9

To solution Gr-1 with stirring at 70° C., Solutions C-1 and C-2 were added by the double jet addition. When 2.961 lit. of Solution C-1 was added (i.e., at the time of 50% of total silver to be used for grain formation having been consumed), addition of Solution C-3 was stopped and instead, Solution C-4 was added. When 4.426 lit. of Solution C-1 was added (i.e., at the time of 75% of total silver to be used for grain formation having been consumed), addition of Solution C-4 was stopped and addition of Solution C-3 was again started.

Solution C-1 and C-3 were again added at a flow rate so that nucleus grains were not formed, while the pAg was maintained at 7.3 with an aqueous 1.75N potassium bromide solution and the pH was maintained at 4.0 with an aqueous acetic acid solution. After completing addition of Solution C-1, the pAg was adjusted to 9.1 with an aqueous 3.5N potassium bromide solution and after stirring further for 2 min, the emulsion was desalted in a manner described in JP-A 5-72658. Thereafter, gelatin was added and dispersed, and the pH and pAg were adjusted to 5.80 and 8.06 at 40° C., respectively. The thus prepared emulsion was denoted as Em-9.

| | |
|---|---|
| Solution C-3 | |
| Potassium bromide | 2915.5 g |
| Distilled water to make | 7.0 lit. |
| Solution C-4 | |
| Potassium bromide | 2624.0 g |
| Potassium iodide | 406.7 g |
| Distilled water to make | 7.0 lit. |

From electron micrographs of the resulting emulsion, it was proved that the emulsion Em-9 was comprised of cubic-formed (rather close to tetradecahedral-formed) silver halide grains having an average edge length of 0.42 μm, exhibiting a variation coefficient of an edge length of 17% and having an average iodide content of 2.5 mol %; and ca. 70% of the total grain projected area was accounted for by grains having a (100) face proportion of 50% or more and exhibiting a variation coefficient of the (100) face proportion among grains of 33%. Further, the grains had a silver halide phase containing 10 mol % iodide and accounting for 25% of the grain volume in the region of 5 to 75%, based on silver to be used for grain growth, from the grain center, i.e., in the region at a depth of 9 to 21% from the (100) face.

Preparation of Emulsion Em-10

To solution Gr-1 with stirring at 70° C., Solutions C-1 and C-5 were added by the double jet addition. When 2.961 lit. of Solution C-1 was added (i.e., at the time of 50% of total silver to be used for grain formation having been consumed), addition of Solution C-5 was stopped and instead, Solution C-6 was added. When 3.528 lit. of Solution C-1 was added (i.e., at the time of 60% of total silver to be used for grain formation having been consumed), addition of Solution C-6 was stopped and addition of Solution C-5 was again started. Solution C-1 and C-5 were again added at a flow rate so that nucleus grains were not formed, while the pAg was maintained at 7.3 with an aqueous 1.75N potassium bromide solution and the pH was maintained at 4.0 with an aqueous acetic acid solution. After completing addition of Solution C-1, the pAg was adjusted to 9.1 with an aqueous 3.5N potassium bromide solution and after stirring further for 2 min, the emulsion was desalted in a manner described in JP-A 5-72658. Thereafter, gelatin was added and dispersed, and the pH and pAg were adjusted to 5.80 and 8.06 at 40° C., respectively. The thus prepared emulsion was denoted as Em-10.

| | |
|---|---|
| Solution C-5 | |
| Potassium bromide | 2857.2 g |
| Potassium iodide | 81.3 g |

-continued

| | |
|---|---|
| Distilled water to make | 7.0 lit. |
| Solution C-6 | |
| Potassium bromide | 2755.1 g |
| Potassium iodide | 223.7 g |
| Distilled water to make | 7.0 lit. |

From electron micrographs of the resulting emulsion, it was proved that the emulsion Em-10 was comprised of cubic-formed silver halide grains having an average edge length of 0.42 μm, exhibiting a variation coefficient of an edge length of 12% and having an average iodide content of 2.5 mol %; and about 90% of the total grain projected area was accounted for by grains having a (100) face proportion of 50% or more and exhibiting a variation coefficient of the (100) face proportion among grains of 18%. Further, the grains had a silver halide phase containing 5.5 mol % iodide and accounting for 10% of the grain volume in the region of 50 to 60%, based on silver to be used for grain growth, from the grain center, , i.e., in the region at a depth of 16 to 21% from the (100) face.

Preparation of Emulsion Em-11

To solution Gr-1 with stirring at 70° C., Solutions C-5 and C-7 were added by the double jet addition. When 3.196 lit. of Solution C-7 was added (i.e., at the time of 55% of total silver to be used for grain formation having been consumed), addition of Solutions (C-5) and (C-7) was stopped and after stirring for 1 min., Solution C-8 was added at a constant flow rate for 2 min. After stirring for 15 min., addition of Solutions C-5 and C-7 was again started. Solutions C-5 and C-7 were again added at a flow rate so that nucleus grains were not formed, while the pAg was maintained at 7.3 with an aqueous 1.75N potassium bromide solution and the pH was maintained at 4.0 with an aqueous acetic acid solution. After completing addition of Solution C-7, the pAg was adjusted to 9.1 with an aqueous 3.5N potassium bromide solution and after stirring further for 2 min, the emulsion was desalted in a manner described in JP-A 5-72658. Thereafter, gelatin was added and dispersed, and the pH and pAg were adjusted to 5.80 and 8.06 at 40° C., respectively. The thus prepared emulsion was denoted as Em-11.

| | |
|---|---|
| Solution C-7 | |
| Silver nitrate | 3524.9 g |
| Distilled water to make | 5.928 lit. |
| Solution C-8 | |
| Silver iodide fine grain emulsion N-2 | 376.1 g |

From electron micrographs of the resulting emulsion, it was proved that the emulsion Em-11 was comprised of cubic-formed silver halide grains having an average edge length of 0.42 μm, exhibiting a variation coefficient of an edge length of 9% and having an average iodide content of 3.0 mol %; and about 94% of the total grain projected area was accounted for by grains having a (100) face proportion of 50% or more and exhibiting a variation coefficient of the (100) face proportion among grains of 14%. Further, the grains had a silver halide phase containing 15 mol % iodide and accounting for 7% of the grain volume in the region of 55 to 62%, based on silver to be used for grain growth, from the grain center, i.e., in the region at a depth of 15 to 18% from the (100) face.

Preparation of Emulsion Em-12

To solution Gr-1 with stirring at 70° C., Solutions C-5 and C-9 were added by the double jet addition. When 3.196 lit. of Solution C-9 was added (i.e., at the time of 55% of total silver to be used for grain formation having been consumed), addition of Solutions (C-5) and (C-9) was stopped and after stirring for 1 min., Solution C-10 was added at a constant flow rate for 2 min. After stirring for 15 min., addition of Solutions C-5 and C-9 was again started, in which the flow rate was ½ of that of Em-11. Solutions C-5 and C-9 were again added at a flow rate so that nucleus grains were not formed, while the pAg was maintained at 7.2 with an aqueous 1.75N potassium bromide solution and the pH was maintained at 4.0 with an aqueous acetic acid solution. After completing addition of Solution C-7, the pAg was adjusted to 9.1 with an aqueous 3.5N potassium bromide solution and after stirring further for 2 min, the emulsion was desalted in a manner described in JP-A 5-72658. Thereafter, gelatin was added and dispersed, and the pH and pAg were adjusted to 5.80 and 8.06 at 40° C., respectively. The thus prepared emulsion was denoted as Em-12.

| | |
|---|---|
| Solution C-9 | |
| Silver nitrate | 3506.9 g |
| Distilled water to make | 5.987 lit. |
| Solution C-10 | |
| Silver iodide fine grain emulsion N-2 | 564.2 g |

From electron micrographs of the resulting emulsion, it was proved that the emulsion Em-12 was comprised of cubic-formed silver halide grains having an average edge length of 0.42 μm, exhibiting a variation coefficient of an edge length of 12% and having an average iodide content of 3.5 mol %; and about 90% of the total grain projected area was accounted for by grains having a (100) face proportion of 50% or more and exhibiting a variation coefficient of the (100) face proportion among grains of 19%. Further, the grains had a silver halide phase containing 12 mol % iodide and accounting for 12% of the grain volume in the region of 55 to 67%, based on silver to be used for grain growth, from the grain center, i.e., in the region at a depth of 12 to 18% from the (100) face.

Preparation of Em-13

To solution Gr-1 with stirring at 70° C., Solutions C-5 and C-9 were added by the double jet addition at a flow rate so that nucleus grains were not formed, while the pAg was maintained at 7.3 with an aqueous 1.75N potassium bromide solution and the pH was maintained at 4.0 with an aqueous acetic acid solution. When 3.196 lit. of Solution C-9 was added (i.e., at the time of 55% of total silver to be used for grain formation having been consumed), addition of Solutions (C-5) and (C-9) was stopped and after stirring for 1 min., Solution C-10 was added at a constant flow rate for 2 min. After stirring for 15 min., addition of Solutions C-5 and C-9 was again started, in which the flow rate was ½ of that of Em-11. Solutions C-5 and C-9 were again added at a flow rate so that nucleus grains were not formed, while the pAg was maintained at 7.2 with an aqueous 1.75N potassium bromide solution and the pH was maintained at 4.0 with an aqueous acetic acid solution. After completing addition of Solution C-9, the pAg was adjusted to 9.1 with an aqueous 3.5N potassium bromide solution and after stirring further for 2 min, the emulsion was desalted in a manner described in JP-A 5-72658. Thereafter, gelatin was added and dispersed, and the pH and pAg were adjusted to 5.80 and 8.06 at 40° C., respectively. The thus prepared emulsion was denoted as Em-13.

From electron micrographs of the resulting emulsion, it was proved that the emulsion Em-13 was comprised of cubic-formed silver halide grains having an average edge length of 0.42 μm, exhibiting a variation coefficient of an edge length of 15% and having an average iodide content of 3.5 mol %; and about 88% of the total grain projected area was accounted for by grains having a (100) face proportion of 50% or more and exhibiting a variation coefficient of the (100) face proportion among grains of 25%. Further, the grains had a silver halide phase containing 12 mol % iodide and accounting for 12% of the grain volume in the region of 55 to 67%, based on silver to be used for grain growth, from the grain center, i.e., in the region at a depth of 12 to 18% from the (100) face.

Preparation of Em-14

To solution Gr-1 with stirring at 70° C., Solutions C-5 and C-9 were added by the double jet addition. When 1.448 lit. of Solution C-9 was added (i.e., at the time of 25% of total silver to be used for grain formation having been consumed), addition of Solutions (C-5) and (C-9) was stopped and after stirring for 1 min., Solution C-10 was added at a constant flow rate for 2 min. After stirring for 15 min., addition of Solutions C-5 and C-9 was again started, in which the flow rate was ½ of that of Em-11. Solutions C-5 and C-9 were again added at a flow rate so that nucleus grains were not formed, while the pAg was maintained at 7.3 with an aqueous 1.75N potassium bromide solution and the pH was maintained at 4.0 with an aqueous acetic acid solution. After completing addition of Solution C-9, the pAg was adjusted to 9.1 with an aqueous 3.5N potassium bromide solution and after stirring further for 2 min, the emulsion was desalted in a manner described in JP-A 5-72658. Thereafter, gelatin was added and dispersed, and the pH and pAg were adjusted to 5.80 and 8.06 at 40° C., respectively. The thus prepared emulsion was denoted as Em-14.

From electron micrographs of the resulting emulsion, it was proved that the emulsion Em-14 was comprised of cubic-formed silver halide grains having an average edge length of 0.42 μm, exhibiting a variation coefficient of an edge length of 15% and having an average iodide content of 3.5 mol %; and about 90% of the total grain projected area was accounted for by grains having a (100) face proportion of 50% or more and exhibiting a variation coefficient of the (100) face proportion among grains of 19%. Further, the grains had a silver halide phase containing 15 mol % iodide and accounting for 10% of the grain volume in the region of 25 to 35%, based on silver to be used for grain growth, from the grain center, i.e., in the region at a depth of 30 to 37% from the (100) face.

Preparation of Em-15

To solution Gr-1 with stirring at 70° C., Solutions C-5 and C-9 were added by the double jet addition. When 5.080 lit. of Solution C-9 was added (i.e., at the time of 85% of total silver to be used for grain formation having been consumed), addition of Solutions (C-5) and (C-9) was stopped and after stirring for 1 min., Solution C-10 was added at a constant flow rate for 2 min. After stirring for 15 min., addition of Solutions C-5 and C-9 was again started. Solutions C-5 and C-9 were again added at a flow rate so that nucleus grains were not formed, while the pAg was maintained at 7.3 with an aqueous 1.75N potassium bromide solution and the pH was maintained at 4.0 with an aqueous acetic acid solution. After completing addition of Solution C-9, the pAg was adjusted to 9.1 with an aqueous 3.5N potassium bromide solution and after stirring further for 2 min, the emulsion was desalted in a manner described in JP-A 5-72658. Thereafter, gelatin was added and dispersed, and the pH and pAg were adjusted to 5.80 and 8.06 at 40° C., respectively. The thus prepared emulsion was denoted as Em-15.

From electron micrographs of the resulting emulsion, it was proved that the emulsion Em-15 was comprised of cubic-formed silver halide grains having an average edge length of 0.42 μm, exhibiting a variation coefficient of an edge length of 17% and having an average iodide content of 3.5 mol %; and about 85% of the total grain projected area was accounted for by grains having a (100) face proportion of 50% or more and exhibiting a variation coefficient of the (100) face proportion among grains of 27%. Further, the grains had a silver halide phase containing 15 mol % iodide and accounting for 10% of the grain volume in the region of 85 to 95%, based on silver to be used for grain growth, from the grain center, i.e., in the region at a depth of 2 to 6% from the (100) face.

Preparation of Em-16

To solution Gr-1 with stirring at 70° C., Solutions C-7 and C-11 were added by the double jet addition. When 3.196 lit. of Solution C-7 was added (i.e., at the time of 55% of total silver to be used for grain formation having been consumed), addition of Solutions (C-7) and (C-11) was stopped and after stirring for 1 min., Solution C-8 was added at a constant flow rate for 2 min. After stirring for 15 min., addition of Solutions C-7 and C-11 was again started. Solutions C-7 and C-11 were again added at a flow rate so that nucleus grains were not formed, while the pAg was maintained at 7.3 with an aqueous 1.75N potassium bromide solution and the pH was maintained at 4.0 with an aqueous acetic acid solution. After completing addition of Solution C-7, the pAg was adjusted to 9.1 with an aqueous 3.5N potassium bromide solution and after stirring further for 2 min, the emulsion was desalted in a manner described in JP-A 5-72658. Thereafter, gelatin was added and dispersed, and the pH and pAg were adjusted to 5.80 and 8.06 at 40° C., respectively. The thus prepared emulsion was denoted as Em-16.

| Solution C-11 | |
|---|---|
| Potassium bromide | 2755.1 g |
| Potassium iodide | 223.7 g |

From electron micrographs of the resulting emulsion, it was proved that the emulsion Em-16 was comprised of cubic-formed silver halide grains having an average edge length of 0.42 μm, exhibiting a variation coefficient of an edge length of 13% and having an average iodide content of 6.5 mol %; and about 83% of the total grain projected area was accounted for by grains having a (100) face proportion of 50% or more and exhibiting a variation coefficient of the (100) face proportion among grains of 19%. Further, the grains had a silver halide phase containing 15 mol % iodide and accounting for 7% of the grain volume in the region of 55 to 62%, based on silver to be used for grain growth, from the grain center, i.e., in the region at a depth of 15 to 18% from the (100) face.

Emulsions Em-7 to Em-16 are summarized in Table 5

TABLE 5

| | High Iodide Phase | | | (100) Grain | |
|---|---|---|---|---|---|
| Emulsion | Position (%)*2 | Volume (%)*3 | I (mol %) | Proportion (%)*1 | Remark |
| Em-7 | — | — | — | 70 | Comp. |
| Em-8 | — | — | — | 93 | Comp. |
| Em-9 | 9–21 | 25 | 10 | 70 | Comp. |
| Em-10 | 16–21 | 10 | 5.5 | 90 | Comp. |
| Em-11 | 15–18 | 7 | 15 | 94 | Inv. |
| Em-12 | 12–18 | 12 | 12 | 90 | Inv. |
| Em-13 | 12–18 | 12 | 12 | 88 | Inv. |
| Em-14 | 30–37 | 10 | 15 | 90 | Comp. |
| Em-15 | 2–6 | 10 | 15 | 85 | Comp. |
| Em-16 | 15–18 | 7 | 15 | 83 | Inv. |

*1Proportion of regular crystal grains exhibiting a proportion of a (100) face per grain of at least 50%, based on the total grain projected area;
*2Depth from (100) face, based on the length between the grain center and the (100) face; and
*3Percentage, based on grain volume.

To each of the emulsions Em-7 to Em-16 were added sensitizing dyes (S-1 and S-2), potassium thiocyanate, chloroauric acid, sodium thiosulfate and triphenylphosphine selenide and chemical sensitization was conducted so as to give the optimum speed-granularity relationship. Subsequently, to each of the emulsion, a stabilizer (ST-1) and antifoggants (AF-1 and AF-2) were added in amounts of 1 g. 3 mg and 20 mg per mol of silver halide, respectively. Further thereto, a coupler (C-1) dispersion and photographic adjuvants such as a coating aid and a hardener were added to prepare a coating solution. The coating solution was coated on a subbed triacetate cellulose film support and dried to obtain photographic material samples 301 to 310.

Similarly to Example 1, samples were evaluated with respect to sensitivity, contrast and pressure resistance.

Sensitivity

Sensitivity was represented by a relative value of the reciprocal of exposure necessary to give a color density of 1.0, based on the sensitivity of Sample 301 being 100.

Contrast (G)

Contrast G was defined as a value of a color density at 1/10 of an exposure giving a color density of 0.5, subtracted by 0.5. The contrast was represented by a relative value, based on the G of Sample 301 being 1. The larger G exhibits a higher contrast emulsion.

Pressure Resistance

Using a scratch hardness tester (produced by SHINTOH KAGAKU Co. Ltd.) under the conditions of 23° C. and 55% RH (relative humidity), a needle having a round top with a curvature radius of 0.025 mm and loaded by a weight of 5 g was allowed to scan at a constant speed on each sample, then the sample was exposed and processed. The difference in density ΔD=D−0.2 was determined, where D is a density obtained when subjecting a loaded portion to exposure giving a density of 0.2 in an unloaded portion. This value is the closer to 0, the more there is in improvement in pressure resistance.

TABLE 6

| Sample | Emulsion | Sensitivity | Contrast | ΔD |
|---|---|---|---|---|
| 301 | Em-7(Comp.) | 100 | 1 | 0.03 |
| 302 | Em-8(Comp.) | 105 | 1.09 | 0 |
| 303 | Em-9(Comp.) | 120 | 0.95 | 0.33 |
| 304 | Em-10(Comp.) | 105 | 1.12 | 0.03 |

TABLE 6-continued

| Sample | Emulsion | Sensitivity | Contrast | ΔD |
|---|---|---|---|---|
| 305 | Em-11(Inv.) | 135 | 1.15 | 0.02 |
| 306 | Em-12(Inv.) | 145 | 1.10 | 0.05 |
| 307 | Em-13(Inv.) | 138 | 1.04 | 0.07 |
| 308 | Em-14(Comp.) | 110 | 1.15 | 0.21 |
| 309 | Em-15(Comp.) | 96 | 0.82 | 0.14 |
| 310 | Em-16(Inv.) | 115 | 0.99 | 0.01 |

As is apparent, inventive emulsions exhibit enhanced sensitivity, higher contrast and superior pressure resistance. From the comparison of Samples 301 and 302, and of Samples 306 and 307, the less variation coefficient of a (100) face proportion among grains is, the better sensitivity, contrast and pressure resistance. From the comparison of Samples 303 and 307, the volume accounted for by a high iodide shell of 15% or less is shown to be preferred, specifically in pressure resistance. From the comparison of Samples 306 and 305, the volume of 8% or less is shown to exhibit markedly improved pressure resistance.

As is apparent from Sample 308, when the high iodide shell is localized more toward the interior position than the invention emulsion grains, it is not preferred in terms of sensitivity and pressure resistance. Further from Sample 309 when the high iodide shell is localized at a position toward the exterior than the inventive emulsion grains, it is not preferred in terms of reduced contrast. From the comparison of Samples 305 and 310, the average iodide content of more than 5 mol % resulted in reduction in contrast, and it is proved that the average iodide content of not more than 5 mol % is preferred.

Example 4

Preparation of Em-17

To solution Gr-1 with stirring at 70° C., Solutions C-7 and C-5 were added by the double jet addition, while the pAg was maintained at 7.6 with an aqueous 1.75N potassium bromide solution and the pH was maintained at 4.0 with an aqueous acetic acid solution. When 3.196 lit. of Solution C-7 was added (i.e., at the time of 55% of total silver to be used for grain formation having been consumed), addition of Solutions (C-7) and (C-5) was stopped and after stirring for 1 min., Solution C-8 was added at a constant flow rate for 2 min. After stirring for 15 min., addition of Solutions C-7 and C-5 was again started. Solutions C-7 and C-11 were again added at a flow rate so that nucleus grains were not formed, while the pAg was maintained at 7.2 with an aqueous 1.75N potassium bromide solution and the pH was maintained at 4.0 with an aqueous acetic acid solution. After completing addition of Solution C-7, the pAg was adjusted to 9.1 with an aqueous 3.5N potassium bromide solution and after stirring further for 2 min, the emulsion was desalted in a manner described in JP-A 5-72658. Thereafter, gelatin was added and dispersed, and the pH and pAg were adjusted to 5.80 and 8.06 at 40° C., respectively. The thus prepared emulsion was denoted as Em-17.

From electron micrographs of the resulting emulsion, it was proved that the emulsion Em-17 was comprised of cubic-formed silver halide grains having an average edge length of 0.42 μm, exhibiting a variation coefficient of an edge length of 11% and having an average iodide content of 3 mol %; and about 94% of the total grain projected area was accounted for by grains having a (100) face proportion of 50% or more and exhibiting a variation coefficient of the (100) face proportion among grains of 16%. Further, the grains had a silver halide phase containing 15 mol % iodide and accounting for 7% of the grain volume in the region of 55 to 62%, based on silver to be used for grain growth, from the grain center, i.e., in the region at a depth of 15 to 18% from the (100) face.

Preparation of Em-18

To solution Gr-1 with stirring at 70° C., Solutions C-7 and C-5 were added by the double jet addition, while the pAg was maintained at 7.2 with an aqueous 1.75N potassium bromide solution and the pH was maintained at 4.0 with an aqueous acetic acid solution. When 3.196 lit. of Solution C-7 was added (i.e., at the time of 55% of total silver to be used for grain formation having been consumed), addition of Solutions (C-7) and (C-5) was stopped and after stirring for 1 min., Solution C-8 was added at a constant flow rate for 2 min. After stirring for 15 min., addition of Solutions C-7 and C-5 was again started. Solutions C-7 and C-11 were added at a flow rate so that nucleus grains were not formed, while the pAg was maintained at 7.6 with an aqueous 1.75N potassium bromide solution and the pH was maintained at 4.0 with an aqueous acetic acid solution. When 4.45 lit. of Solution C-7 was added, addition of Solution C-5 was stopped; and when the pAg reached 7.3, the addition of Solution C-5 was started, while the pAg was maintained at 7.3 with an aqueous 1.75N potassium bromide solution and the pH was maintained at 4.0 with an aqueous acetic acid solution, until completion of the addition of Solution C-7. After completing addition of Solution C-7, the pAg was adjusted to 9.1 with an aqueous 3.5N potassium bromide solution and after stirring further for 2 min, the emulsion was desalted in a manner described in JP-A 5-72658. Thereafter, gelatin was added and dispersed, and the pH and pAg were adjusted to 5.80 and 8.06 at 40° C., respectively. The thus prepared emulsion was denoted as Em-18.

From electron micrographs of the resulting emulsion, it was proved that the emulsion Em-18 was comprised of cubic-formed silver halide grains having an average edge length of 0.42 μm, exhibiting a variation coefficient of an edge length of 14% and having an average iodide content of 3 mol %; and about 92% of the total grain projected area was accounted for by grains having a (100) face proportion of 50% or more and exhibiting a variation coefficient of the (100) face proportion among grains of 19%. Further, the grains had a silver halide phase containing 15 mol % iodide and accounting for 7% of the grain volume in the region of 55 to 62%, based on silver to be used for grain growth, from the grain center, i.e., in the region at a depth of 15 to 18% from the (100) face.

According to the method afore-mentioned, emulsions Em-11, Em-17 and Em-18 each were measure with respect to the high iodide containing phase, as shown in Tables 7-1 and 7-2.

TABLE 7-1

| | High Iodide Phase | | | (100) Grain | |
|---|---|---|---|---|---|
| Emulsion | Position (*)*2 | Volume (%)*3 | I (mol %) | Proportion (%)*1 | Remark |
| Em-11 | 15–18 | 7 | 15 | 94 | Inv. |
| Em-17 | 15–18 | 7 | 15 | 94 | Inv. |
| Em-18 | 15–18 | 7 | 15 | 92 | Inv. |

*1Proportion of regular crystal grains exhibiting a proportion of a (100) face per grain of at least 50%, based on the total grain projected area;
*2Depth from (100) face, based on the length between the grain center and the (100) face; and
*3Percentage, based on grain volume.

TABLE 7-2

| Emulsion | Proportion of grains having high iodide phase at position facing to (100) surface* | Proportion of grains having high iodide phase at position facing edge, corner, (111) surface and (110) surface* |
|---|---|---|
| Em-11 (Inv.) | 56 | 83 |
| Em-17 (Inv.) | 33 | 85 |
| Em-18 (Inv.) | 66 | 41 |

*Based on the total grain projected area.

To each of the emulsions Em-11, Em-17 and Em-18 were added the following sensitizing dyes (S-3 and S-4), potassium thiocyanate, chloroauric acid, sodium thiosulfate and triphenylphosphine selenide and chemical sensitization was conducted so as to give the optimum speed-granularity relationship. Subsequently, to each of the emulsion, a stabilizer (ST-1) and antifoggants (AF-1 and AF-2) were added in amounts of 1 g. 3 mg and 20 mg per mol of silver halide, respectively. Further thereto, a coupler (C-1) dispersion and photographic adjuvants such as a coating aid and a hardener were added to prepare a coating solution. The coating solution was coated on a subbed triacetate cellulose film support and dried to obtain photographic material sample 401 402 or 403.

S-3

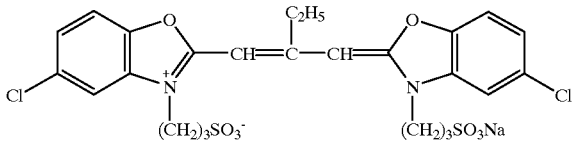

S-4

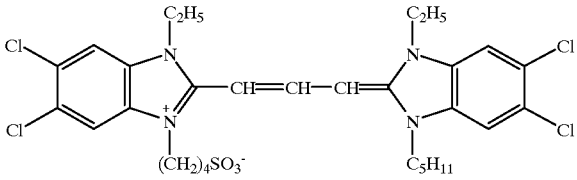

M-1

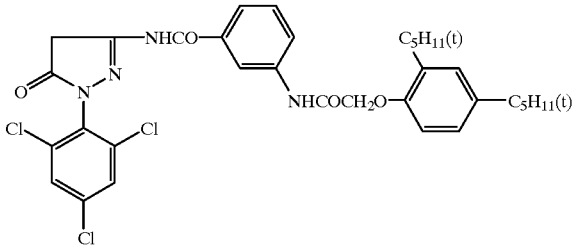

Samples each were exposed through TOSHIBA Glass Filter Y-48, processed in a manner similar to Example 3, except that the first developing time was changed to 5 min and evaluated with respect to sensitivity and pressure resistance (ΔD). Results thereof are shown in Table 8.

TABLE 8

| Sample | Emulsion | Sensitivity | ΔD |
|---|---|---|---|
| 401 | Em-11(Inv.) | 100 | 0.05 |
| 402 | Em-17(Inv.) | 110 | 0.07 |
| 403 | Em-18(Inv.) | 98 | 0.01 |

As is apparent from the Table, emulsion Em-17 exhibits high sensitivity and emulsion Em-18 exhibiting superior pressure resistance.

Example 5

Preparation of Em-19

To solution Gr-1 with stirring at 70° C., Solutions C-7 and C-5 were added by the double jet addition, while the pAg was maintained at 7.2 with an aqueous 1.75N potassium bromide solution and the pH was maintained at 4.0 with an aqueous acetic acid solution. When 3.196 lit. of Solution C-7 was added (i.e., at the time of 55% of total silver to be used for grain formation having been consumed), addition of Solutions (C-7) and (C-5) was stopped and after stirring for 1 min., Solution C-8 was added at a constant flow rate for 2 min. After stirring for 1 min., addition of Solutions C-7 and C-5 was again started. Solutions C-7 and C-11 were added at a flow rate so that nucleus grains were not formed, while the pAg was maintained at 7.6 with an aqueous 1.75N potassium bromide solution and the pH was maintained at 4.0 with an aqueous acetic acid solution. When 4.45 lit. of Solution C-7 was added, addition of Solution C-5 was stopped; and when the pAg reached 7.3, the addition of Solution C-5 was started, while the pAg was maintained at 7.3 with an aqueous 1.75N potassium bromide solution and the pH was maintained at 4.0 with an aqueous acetic acid solution, until completion of the addition of Solution C-7. After completing addition of Solution C-7, the pAg was adjusted to 9.1 with an aqueous 3.5N potassium bromide solution and after stirring further for 2 min, the emulsion was desalted in a manner described in JP-A 5-72658. Thereafter, gelatin was added and dispersed, and the pH and pAg were adjusted to 5.80 and 8.06 at 40° C., respectively. The thus prepared emulsion was denoted as Em-19.

From electron micrographs of the resulting emulsion, it was proved that the emulsion Em-19 was comprised of cubic-formed silver halide grains having an average edge length of 0.42 μm, exhibiting a variation coefficient of an edge length of 14% and having an average iodide content of 3 mol %; and about 90% of the total grain projected area was accounted for by grains having a (100) face proportion of 50% or more and exhibiting a variation coefficient of the (100) face proportion among grains of 19%. Further, the grains had a silver halide phase containing 7.5 mol % iodide and accounting for 13% of the grain volume in the region of 55 to 68%, based on silver to be used for grain growth, from the grain center, i.e., in the region at a depth of 12 to 18% from the (100) face.

Preparation of Em-20

To solution Gr-1 with stirring at 70° C., Solutions C-7 and C-5 were added by the double jet addition, while the pAg was maintained at 7.2 with an aqueous 1.75N potassium bromide solution and the pH was maintained at 4.0 with an aqueous acetic acid solution. When 3.196 lit. of Solution C-7 was added (i.e., at the time of 55% of total silver to be used for grain formation having been consumed), addition of Solutions (C-7) and (C-5) was stopped and after stirring for 1 min., Solution C-8 was added at a constant flow rate for 2 min. After stirring for 1 min., addition of Solutions C-7 and C-5 was again started. Solutions C-7 and C-11 were added at a flow rate so that nucleus grains were not formed, while the pAg was maintained at 7.2 with an aqueous 1.75N potassium bromide solution and the pH was maintained at 4.0 with an aqueous acetic acid solution. After completing addition of Solution C-7, the pAg was adjusted to 9.1 with an aqueous 3.5N potassium bromide solution and after stirring further for 2 min, the emulsion was desalted in a manner described in JP-A 5-72658. Thereafter, gelatin was added and dispersed, and the pH and pAg were adjusted to 5.80 and 8.06 at 40° C., respectively. The thus prepared emulsion was denoted as Em-20.

From electron micrographs of the resulting emulsion, it was proved that the emulsion Em-20 was comprised of cubic-formed silver halide grains having an average edge length of 0.42 μm, exhibiting a variation coefficient of an edge length of 11% and having an average iodide content of 3 mol %; and about 93% of the total grain projected area was accounted for by grains having a (100) face proportion of 50% or more and exhibiting a variation coefficient of the (100) face proportion among grains of 18%. Further, the grains had a silver halide phase containing 10 mol % iodide and accounting for 10% of the grain volume in the region of 55 to 65%, based on silver to be used for grain growth, from the grain center, i.e., in the region at a depth of 14 to 18% from the (100) face.

Emulsions Em-7 to Em-16 are summarized in Table 9-1

Table 9-1

TABLE 9-1

| | High Iodide Phase | | | (100) Grain | |
|---|---|---|---|---|---|
| Emulsion | Position (%)*2 | Volume (%)*3 | I (mol %) | Proportion (%)*1 | Remark |
| Em-11 | 15–18 | 7 | 15 | 94 | Inv. |
| Em-19 | 12–18 | 13 | 7.5 | 90 | Inv. |
| Em-20 | 14–18 | 10 | 10 | 88 | Inv. |

*1Proportion of regular crystal grains exhibiting a proportion of a (100) face per grain of at least 50%, based on the total grain projected area;
*2Depth from (100) face, based on the length between the grain center and the (100) face; and
*3Percentage, based on grain volume.

According to the method afore-mentioned, emulsions 11, Em-19 and Em-20 were measure with respect to the number of dislocation lines of a grain and their orientation. Results thereof are shown in Table 8-2.

TABLE 9-2

| Emulsion | Proportion-1 (%)* | Proportion-2 (%)** | Proportion-3 (%)*** |
|---|---|---|---|
| Em-11(Inv.) | 45 | 41 | 35 |
| Em-19(Inv.) | 67 | 19 | 60 |
| Em-20(Inv.) | 77 | 24 | 73 |

*Proportion of grains having 10 or more dislocation lines per grain, based on the total grain projected area.
**Proportion of grains having dislocation lines, at least 60% of which orient to corner, edge, (111) face or (110) face, based on the total grain projected area.
***Proportion of grains having dislocation lines, at least 60% of which orient to (100) face, based on the total grain projected area.

Using emulsions Em-19 and Em-20, photographic material Samples 501 and 502 were prepared and evaluated with respect to sensitivity and pressure resistance in a manner similar to Example 4. Results thereof are shown in Table 10.

TABLE 10

| Sample | Emulsion | Sensitivity | ΔD |
|---|---|---|---|
| 401 | Em-11(Inv.) | 100 | 0.05 |
| 501 | Em-19(Inv.) | 112 | 0.01 |
| 502 | Em-20(Inv.) | 120 | 0.06 |

As is apparent from the Table, emulsion Em-19 exhibited high sensitivity as well as superiod pressure resistance. Emulsion Em-20 was useful in terms of high sensitivity.

Example 6

Emulsion 21 was prepared in a manner similar to emulsion Em-12 of example 3, except that iodide ion-releasing agent (exemplified Compound 58) was used in place of Solution C-10.

From electron micrographs of the resulting emulsion, it was proved that the emulsion Em-21 was comprised of cubic-formed silver halide grains having an average edge length of 0.42 μm, exhibiting a variation coefficient of an edge length of 13% and having an average iodide content of 3.5 mol %; and about 90% of the total grain projected area was accounted for by grains having a (100) face proportion of 50% or more and exhibiting a variation coefficient of the (100) face proportion among grains of 20%. Further, the grains had a silver halide phase containing 14 mol % iodide and accounting for 10% of the grain volume in the region of 55 to 65%, based on silver to be used for grain growth, from the grain center, i.e., in the region at a depth of 14 to 18% from the (100) face.

Emulsion Em-21 was evaluated in a manner similar to Example 3. As a result, emulsion Em-21 exhibited superior performance, which was the same level as Em-12.

What is claimed is:

1. A silver halide emulsion comprising silver halide grains, wherein at least 50% of total grain projected area is accounted for by silver halide regular crystal grains exhibiting a proportion of a (100) face per grain of 70% to 95% and having an average iodide content of not more than 5 mol %; said silver halide grains having an internal high iodide phase having an average iodide content of not less than 7 mol % and accounting for 0.1 to 15% of the grain volume and an outermost surface layer having an iodide content of not more than 10 mol %; said high iodide phase being in the region at a depth of from 7 to 27% from the (100) face, based on the distance between the center of a grain and the (100) face.

2. The silver halide emulsion of claim 1, wherein said high iodide phase is at a position facing a (100) face of the grain.

3. The silver halide emulsion of claim 1, wherein said high iodide phase is at a position facing a corner, an edge, a (111) face or a (110) face.

4. The silver halide emulsion of claim 1, wherein said high iodide phase is in the overall region as defined in claim 1.

5. The silver halide emulsion of claim 1, wherein said high iodide phase has a thickness of not more than 0.1 μm.

6. The silver halide emulsion of claim 1, wherein said silver halide grains each have dislocation lines which are oriented toward the surface of the grain.

7. The silver halide emulsion of claim 6, wherein said silver halide grains have at least 10 dislocation lines per grain, at least 60% of the dislocation lines being oriented toward the (100) face of the grain.

8. The silver halide emulsion of claim 6, wherein said silver halide grains have at least 10 dislocation lines per grain, at least 60% of the dislocation lines of the grain being oriented toward a corner, an edge, a (111) face or a (110) face of the grain.

9. The silver halide emulsion of claim 1, wherein said silver halide grains exhibit a variation coefficient of grain size of not more than 20%.

10. The silver halide emulsion of claim 1, wherein a variation coefficient of a proportion of the (100) face of a grain among grains is not more than 20%.

11. A silver halide light sensitive photographic material comprising a support having thereon a silver halide emulsion layer, wherein said silver halide emulsion layer comprises a silver halide emulsion as claimed in claim 1.

12. A silver halide light sensitive color reversal photographic material comprising a support having thereon a silver halide emulsion layer, wherein said silver halide emulsion layer comprises a silver halide emulsion as claimed in claim 1.

13. A method of preparing a silver halide emulsion comprising silver halide regular grains exhibiting a proportion of a (100) face per grain of 70% to 95% accounting for at least 50% of total grain projected area and having an average iodide content of not more than 5 mol %, the silver halide grains having an internal high iodide phase having an average iodide content of not less than 7 mol % and accounting for 0.1 to 15% of the grain volume and an outermost surface layer having an iodide content of not more than 10 mol %, the method comprising:

(i) forming nuclear grains by adding a silver salt and a halide salt to a mother liquor, (ii) ripening the nuclear grains, and (iii) growing the nuclear grains to form final grains by adding a silver salt and a halide salt, wherein in (iii), fine silver iodide grains, an aqueous soluble iodide salt or an iodide ion releasing compound is added at a time after adding of 40% of the silver salt to be added and before adding of 80% of the silver salt to be added.

* * * * *